US011020998B2

(12) United States Patent
Asano

(10) Patent No.: US 11,020,998 B2
(45) Date of Patent: Jun. 1, 2021

(54) PRINTED MATTER

(71) Applicant: Shunichi Asano, Yokohama (JP)

(72) Inventor: Shunichi Asano, Yokohama (JP)

( * ) Notice: Subject to any disclaimer, the term of this patent is extended or adjusted under 35 U.S.C. 154(b) by 605 days.

(21) Appl. No.: 15/534,400

(22) PCT Filed: Dec. 15, 2015

(86) PCT No.: PCT/JP2015/085016
§ 371 (c)(1),
(2) Date: Jun. 8, 2017

(87) PCT Pub. No.: WO2016/098756
PCT Pub. Date: Jun. 23, 2016

(65) Prior Publication Data

US 2017/0368860 A1 Dec. 28, 2017

(30) Foreign Application Priority Data

Dec. 18, 2014 (JP) ..... JP2014-256215
Apr. 16, 2015 (JP) ..... JP2015-084532

(51) Int. Cl.
*B41M 5/50* (2006.01)
*G09F 13/04* (2006.01)
(Continued)

(52) U.S. Cl.
CPC ..... *B41M 5/502* (2013.01); *B44F 1/02* (2013.01); *B44F 1/04* (2013.01); *B44F 1/06* (2013.01);
(Continued)

(58) Field of Classification Search
CPC . B41M 3/06; B41M 5/502; B44F 1/02; B44F 1/04; B44F 1/06; B44F 7/00; G09F 13/04; G09F 13/16; G09F 2013/0422
See application file for complete search history.

(56) References Cited

U.S. PATENT DOCUMENTS

2004/0256754 A1 12/2004 Koguchi
2007/0014127 A1* 1/2007 Hara ..... G02B 6/005 362/611
(Continued)

FOREIGN PATENT DOCUMENTS

EP 0656265 6/1995
JP 05-131799 5/1993
(Continued)

OTHER PUBLICATIONS

Machine Translation of JP 2014-203671 (Year: 2014).*
(Continued)

*Primary Examiner* — Lucas A Stelling
*Assistant Examiner* — Sathavaram I Reddy

(57) ABSTRACT

Printed matter that includes a light-transmissive substrate, a laminated clear layer, and a light adjustment layer. The laminated clear layer is disposed above a main surface of the substrate, and is composed of clear element layers that are light-transmissive. The light adjustment layer has a function of adjusting an amount of light transmitted therethrough and is disposed on the laminated clear layer and/or interposed between a plurality of the clear element layers. The adjustment layer includes light reflective particles and covers a portion of a surface of a layer thereunder. Each of the light reflective particles is granular and has a light reflective surface. The light adjustment layer, in terms of surface area ratio in plan view, covers from 2% to 50% of the surface of the layer thereunder.

20 Claims, 15 Drawing Sheets

(51) Int. Cl.

| | |
|---|---|
| ***B44F 1/04*** | (2006.01) |
| ***B44F 1/02*** | (2006.01) |
| ***B44F 1/06*** | (2006.01) |
| ***B44F 7/00*** | (2006.01) |
| ***G09F 13/16*** | (2006.01) |
| ***B41M 3/06*** | (2006.01) |

(52) U.S. Cl.
CPC ..... *B44F 7/00* (2013.01); *G09F 13/04* (2013.01); *G09F 13/16* (2013.01); *B41M 3/06* (2013.01); *G09F 2013/0422* (2013.01)

(56) References Cited

U.S. PATENT DOCUMENTS

| | | | | |
|---|---|---|---|---|
| 2009/0155483 | A1 | 6/2009 | Mariotti et al. | |
| 2011/0255835 | A1* | 10/2011 | Yagi ..... | G02B 6/0011 385/129 |

FOREIGN PATENT DOCUMENTS

| | | |
|---|---|---|
| JP | 11-143414 | 5/1999 |
| JP | 2000-502967 | 3/2000 |
| JP | 2001-255606 | 9/2001 |
| JP | 2004-306593 | 11/2004 |
| JP | 2008-087287 | 4/2008 |
| JP | 2009-160932 | 7/2009 |
| JP | 2010-076365 | 4/2010 |
| JP | 2013-230625 | 11/2013 |
| JP | 2013-237198 | 11/2013 |
| JP | 2014-203671 | 10/2014 |
| WO | WO1997/25213 | 7/1997 |
| WO | WO2014/134752 | 9/2014 |

OTHER PUBLICATIONS

International Search Report (dated Mar. 22, 2016) for International PCT Patent Application No. PCT/JP2015/085016, filed Dec. 15, 2015 with English language translation (8 pages).
Extended European Search Report dated Sep. 28, 2018 for corresponding European Patent Application No. 15869961.1(7 pages).

* cited by examiner

2%

4%

6%

8%

10%

12%

14%

16%

18%

20%

22%

24%

26%

28%

30%

40%

50%

60%

70%

80%

90%

100%

PRINTED MATTER

TECHNICAL FIELD

The present invention relates to printed matter, and in particular to techniques related to improvement of image quality in stereoscopic printing.

BACKGROUND ART

Various types of printed matter have been developed that allow printed images to be perceived stereoscopically (Patent Literature 1 to 5). Example include printed matter in which a lenticular lens is formed on an image printed on a medium (Patent Literature 1), and printed matter in which surface irregularities are formed by a clear layer made of a light-transmissive resin, and images formed above or below the resin are perceived to be stereoscopic (Patent Literature 2, 3).

Further, printed matter has been developed in which a white reflective layer partially covers a medium and an image printed thereon can be perceived stereoscopically due to a difference in visual effect between a position where the white reflective layer is provided and a position where the white reflective layer is not provided (Patent Literature 4, 5).

Printed matter has also been developed in which in addition to light irradiating a front side of the printed matter, reflected light causing a viewer to perceive an image, light is made incident on a back side of the medium, transmitted light causing a viewer to perceive an image.

CITATION LIST

Patent Literature

[Patent Literature 1] JP 2001-255606
[Patent Literature 2] JP 2010-76365
[Patent Literature 3] JP 2013-230625
[Patent Literature 4] JP H05-131799
[Patent Literature 5] JP 2008-87287
[Patent Literature 6] JP 2014-203671

SUMMARY OF INVENTION

Technical Problem

However, in a case in which clear layers are formed so as to allow stereoscopic perception, a problem occurs in that light irradiated from a back surface of the medium takes on a color. For example, at a position intended to be expressed as white, yellowing occurs at a position where the clear layers are laminated.

Such a problem of coloring of transmitted light becomes a cause of deteriorating image quality when an image is perceived via transmitted light.

The present invention has been made to solve such a problem, and it is an object of the present invention to provide printed matter that can achieve high image quality in both a case of perception of an image via transmitted light and a case of perception of an image via reflected light.

Solution to Problem

Printed matter pertaining to one aspect of the present invention includes a substrate, a laminated clear layer, and a light adjustment layer.

The substrate is light-transmissive.

The laminated clear layer is disposed above a main surface (single main surface) of the substrate, and is composed of clear element layers that are light-transmissive.

The light adjustment layer has a function of adjusting an amount of light transmitted therethrough and is disposed on the laminated clear layer and/or interposed between a plurality of the clear element layers.

The light adjustment layer includes light reflective particles and covers a portion of a surface thereunder. Each of the light reflective particles is granular and has a light reflective surface. The light adjustment layer, in terms of surface area ratio in plan view, covers from 2% to 50% of the surface of the layer thereunder.

Advantageous Effects of Invention

According to the printed matter pertaining to the above aspect it is possible to realize a high image quality both in a case in which an image is perceived via transmitted light and in a case in which an image is perceived via reflected light.

EMBODIMENTS

Aspects of Present Invention

Figure 1:
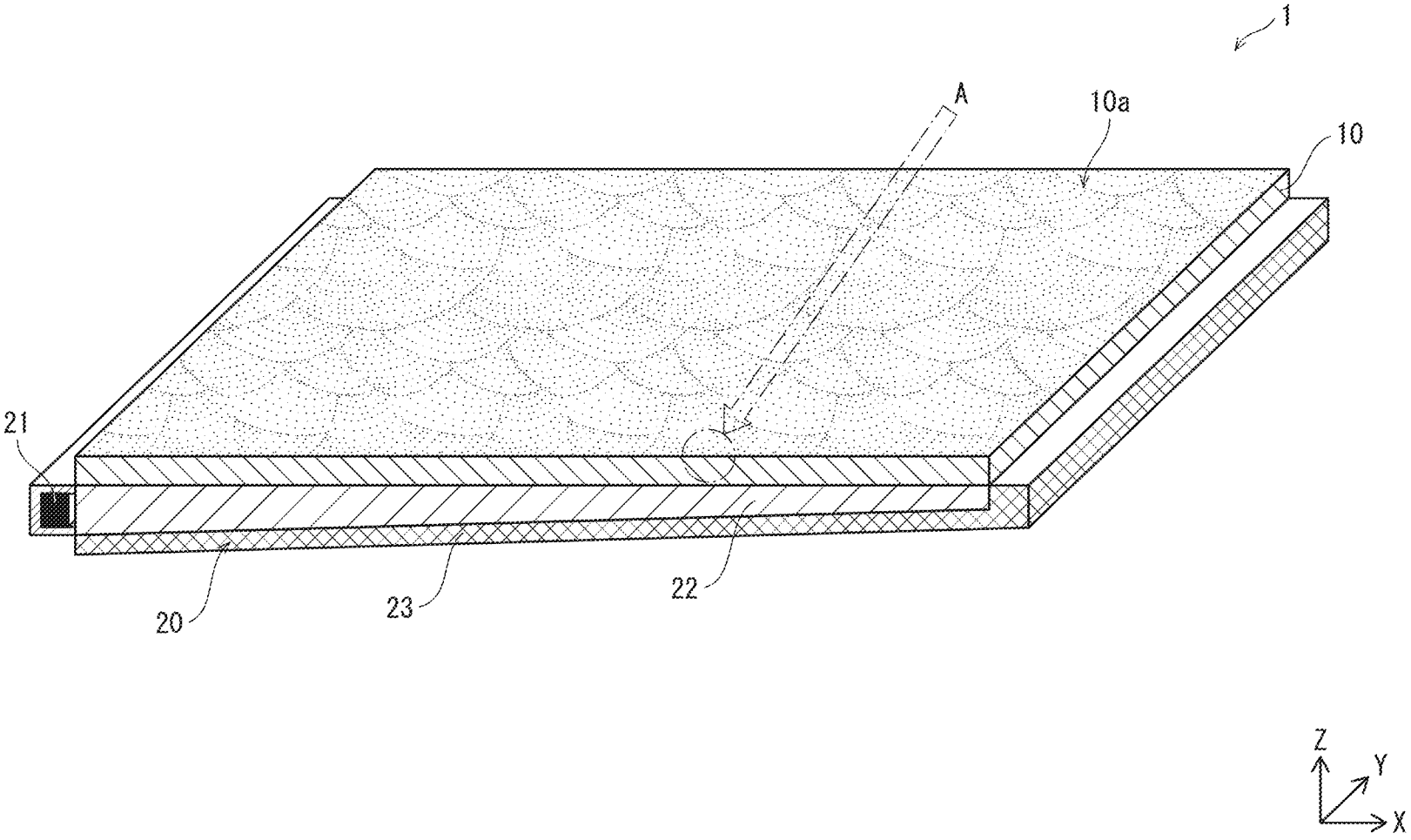
FIG. 1 is a schematic perspective view showing outer appearance of illumination device 1 pertaining to Embodiment 1.

Printed matter pertaining to one aspect of the present invention includes a substrate, a laminated clear layer, and a light adjustment layer.

The substrate is light-transmissive.

The laminated clear layer is disposed above a main surface (single main surface) of the substrate, and is composed of clear element layers that are light-transmissive. Note that in the present description, "disposed above" includes both a case in which a layer is disposed directly on an underlying layer and a case in which the layer is disposed above the underlying layer with another layer interposed therebetween.

The light adjustment layer has a function of adjusting an amount of light transmitted therethrough and is disposed on the laminated clear layer and/or interposed between a plurality of the clear element layers.

The light adjustment layer includes light reflective particles and covers a portion of a surface thereunder. Each of the light reflective particles is granular and has a light reflective surface. The light adjustment layer, in terms of surface area ratio in plan view, covers from 2% to 50% of the surface of the layer thereunder.

According to the printed matter pertaining to the aspect above, the light adjustment layer covers from 2% to 50% of surface area ratio of a surface of an underlying layer (corresponding to "density from 2% to 50%), and therefore it is possible to realize a high image quality both when an image is perceived via transmitted light and when an image is perceived via reflected light.

According to the printed matter pertaining to the aspect above, when a form is adopted in which the light adjustment layer is disposed above the laminated clear layer, an effect is achieved even in terms of obtaining a high quality image such as emphasizing black color (darkness) or a sense of depth.

According to another example of the printed matter pertaining to an aspect of the present invention, the light adjustment layer is provided in a dot pattern. According to this configuration it is possible to realize a high image quality both in a case in which an image is perceived via transmitted light and in a case in which an image is perceived via reflected light.

Here, "dot pattern" means a layer formed from a pattern (dot pattern) of small dots printed on a surface of an underlying layer, and includes cases in which adjacent dots are connected to each other.

Another example of the printed matter pertaining to an aspect of the present invention further comprises a color layer. The color layer is disposed above the main surface of the substrate, extending in a direction along the main surface of the substrate, and including one color or a plurality of colors.

Thus, according to an aspect of the present invention that includes the color layer, a viewer can perceive a vividly expressed image. Further, by providing the light adjustment layer, excellent color reproduction can be realized, in particular when perceiving an image via transmitted light.

According to another example of the printed matter pertaining to an aspect of the present invention (hereinafter, "first aspect"), the color layer is disposed covering a top surface of the laminated clear layer, and the light adjustment layer is disposed covering a top surface of the color layer and side surfaces of the laminated clear layer and the color layer. By disposing the light adjustment layer so as to cover a part of the laminated clear layer and the color layer in this way, when light is made incident on a back surface of the substrate (other main surface) and transmitted through the laminated clear layer, color tinting (for example, yellowing) of light can be suppressed.

Accordingly, when a viewer perceives an image composed from the color layer, it is possible to ensure high image quality in both a case of reflected light and a case of transmitted light. In particular, this is effective from a viewpoint of improving image quality when a white color or pale color is expressed in an image.

According to the first aspect, it is also possible to reproduce an image with transparency by adding a clear layer having a thin thickness on the light adjustment layer.

Another example of the printed matter pertaining to an aspect of the present invention (hereinafter, "second aspect") further comprises a second light adjustment layer. The second light adjustment layer has a function of adjusting an amount of light transmitted therethrough, and is interposed between the main surface of the substrate and the laminated clear layer. The second light adjustment layer includes light reflective particles that are granular and each have a light reflective surface. The second light adjustment layer, in terms of surface area ratio in plan view, covers from 2% to 50% of a surface of a layer thereunder.

For a region where transmitted light is to be completely shielded, a reflective layer (white layer) can be formed at a density of 100%, for example.

Thus, when the second light adjustment layer is disposed between a main surface of the substrate and the laminated clear layer and a viewer perceives an image via reflected light, a portion of light that is incident from above is reflected at the second light adjustment layer. Thus, a ratio of the amount of reflected light to light incident from above can be increased.

According to the printed matter pertaining to the second aspect it is possible to further improve image quality both in a case in which an image is perceived via transmitted light and in a case in which an image is perceived via reflected light.

According to another example of the printed matter pertaining to an aspect of the present invention, the surface area ratio (density) of coverage by the second light adjustment layer is greater than the surface area ratio (density) of coverage by the light adjustment layer. Thus, it is possible to reliably achieve the light reflection function of the second light adjustment layer.

According to another example of the printed matter pertaining to an aspect of the present invention (hereinafter, "third aspect"), the light adjustment layer is disposed covering a top surface and side surfaces of the laminated clear layer, and the color layer is disposed covering a top surface of the light adjustment layer. Thus, according to an aspect in which the light adjustment layer covers the laminated clear layer and is disposed below the color layer, when a viewer perceives an image via light that is incident on a back surface of the substrate and transmitted, it is possible to suppress effects on color tone caused by irregular reflection of light at the laminated clear layer. Irregular reflection of transmitted light in the laminated clear layer is thought to be caused, for example, by surface irregularity of an upper side or lower side of each clear element layer.

Accordingly, when a viewer perceives an image composed from the color layer, it is also possible for printed matter pertaining to the third aspect to ensure high image quality in both a case of reflected light and a case of transmitted light.

According to another example of the printed matter pertaining to an aspect of the present invention, the color layer is a layered body composed of a plurality of color element layers. By forming the color layer as a multilayer structure, texture of an image can be enhanced.

Another example of the printed matter pertaining to an aspect of the present invention further comprises a protective layer. The protective layer is light transmissive and disposed covering a top surface of a top layer thereunder (the protective layer is disposed as the topmost surface of the printed matter). Thus, according to an aspect in which the protective layer is disposed as the topmost surface of a layered structure, it is possible, by applying a pseudo-embossing process according to arrangement of the laminated clear layer, to protect layers disposed under the protective layer such as the light adjustment layer and the clear element layer even if a viewer that perceives an image touches a surface of the printed matter. Further, according to an aspect that includes the color layer, it is also possible to prevent fading of the color layer by selecting a type of protective layer.

According to another example of the printed matter pertaining to an aspect of the present invention, the protective layer is subjected to a matt treatment. For example, this can be implemented by forming an irregular surface. Thus, according to an aspect in which a surface of the protective layer is subjected to a matt treatment (matting), texture of an image can be changed between a treated and untreated region. For example, a region of an image that represents a glossy metal surface or the like is not subjecting to matt treatment and is set to be glossy, and a region of the image that represents a rough surface is subjected to matt treatment.

Another example of printed matter pertaining to an aspect of the present invention further comprises a second laminated clear layer disposed above the laminated clear layer and the light adjustment layer, composed of clear element layers that are light transmissive. According to disposition of the second light laminated clear layer in this way, it is possible to further enhance color tone of an image. In particular, according to an aspect that includes the color layer, color of a deep color portion of the color layer can be further emphasized and a higher degree of texture can be realized.

According to another example of the printed matter pertaining to an aspect of the present invention, in plan view, the surface area ratio (density) of coverage by the light adjustment layer is from 20% to 30%. According to this density range, it is possible to ensure higher print quality in both a case in which a viewer perceives an image via transmitted light and a case in which a viewer perceives an image via reflected light.

According to another example of the printed matter pertaining to an aspect of the present invention, the light reflective particles of the light adjustment layer are made of white pigment. According to such a configuration, for example, it is possible to form the light adjustment layer by dropping ultraviolet (UV) curable ink by using an inkjet device, allowing easy production. As described above, it is also possible to preliminarily apply a primer to a surface of an underlying layer in consideration of ink affinity of the underlying layer.

According to another example of the printed matter pertaining to an aspect of the present invention, thickness of the light adjustment layer is from 0.010 mm to 0.030 mm. By regulating thickness of the light adjustment layer to the above range, it is possible to ensure high image quality in both a case in which an image is perceived via transmitted light and a case in which an image is perceived via reflected light.

According to another example of the printed matter pertaining to an aspect of the present invention, the substrate is made of resin or glass.

The following describes embodiments with reference to the drawings.

Note that the embodiments pertaining to the following description are used as examples for simple explanation of characterizing features and effects achieved by the characterizing features of the present invention, and aside from essential characterizing features, the present invention is not limited in any way to the embodiments below.

Embodiment 1

1. Schematic Configuration of Illumination Device 1

Schematic configuration of illumination device 1 pertaining to the present embodiment is described with reference to FIG. 1.

As shown in FIG. 1, the illumination device 1 is configured to have a backlight 20 and printed matter 10. The illumination device 1 includes other elements such as driver circuitry, but these are not illustrated.

A pseudo embossing process (ink embossing process) is applied to a main face (front face) of the printed matter 10.

The backlight 20 includes an LED 21 as a light source, disposed facing an end face of a light guide plate 22 (edge light system). The printed matter 10 is disposed in close contact with a Z axis direction top face of the light guide plate 22. A Z axis direction bottom face and an end face not facing the LED 21 of the light guide plate 22 are covered by a reflection plate 23.

2. Schematic Configuration of Printed Matter 10

Figure 2:
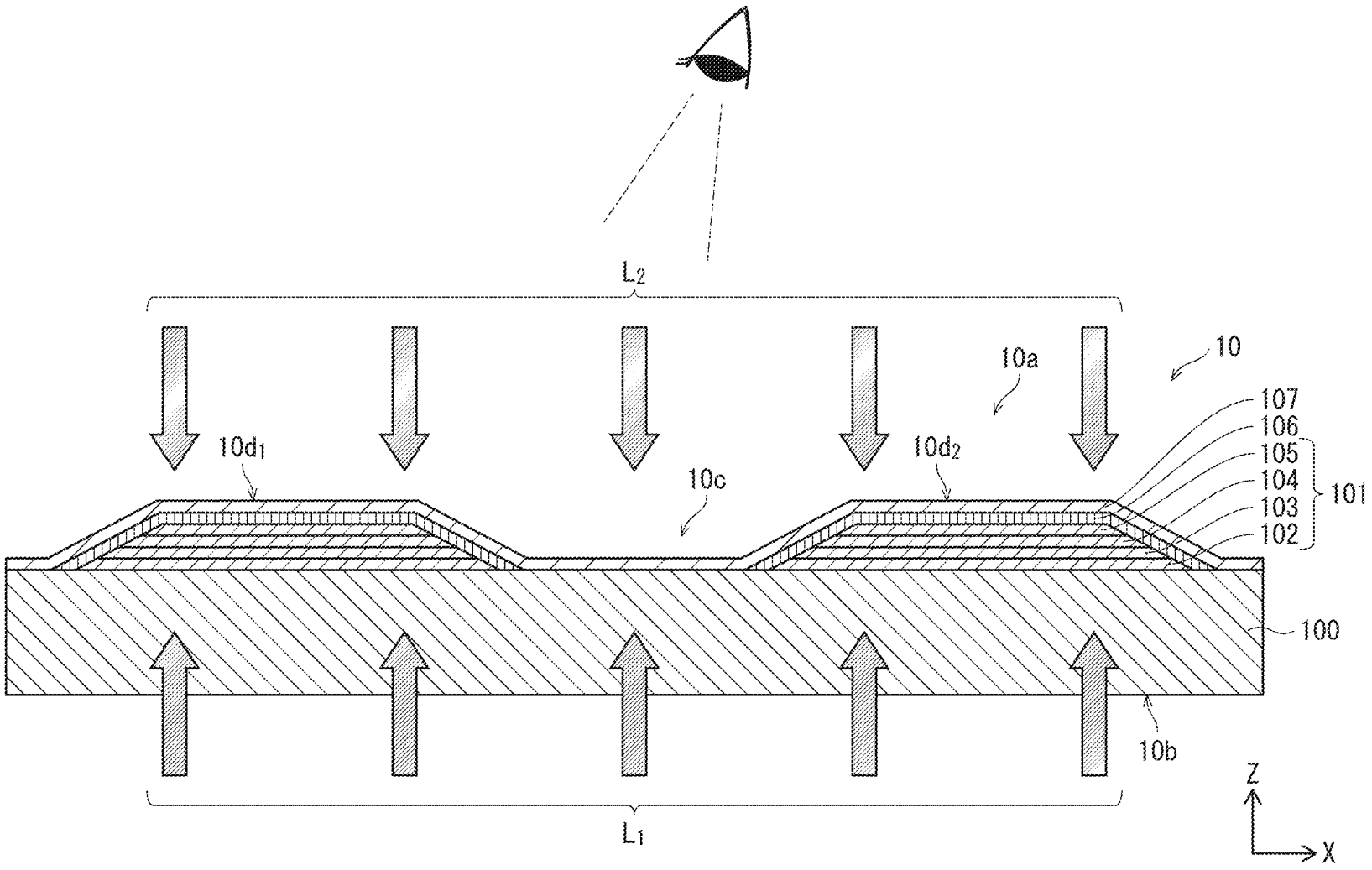
FIG. 2 is a schematic cross section showing configuration of printed matter 10 provided to illumination device 1.

Schematic configuration of printed matter 10 is described with reference to FIG. 2. FIG. 2 is a schematic cross section enlargement of portion A in FIG. 1.

As shown in FIG. 2, a light diffusion plate 100 is formed as a base substrate and one main surface (front surface) 10*a* thereof is subjected to ink embossing treatment. A back surface 10*b* is disposed in close contact with the light guide plate 22 (see FIG. 1). Here, the light diffusion plate 100 is made of an acrylic resin and matting of a surface thereof imparts a light diffusing function thereto.

Convex portions $\mathbf{10}d_1$, $\mathbf{10}d_2$ are formed on the Z axis top surface of the light diffusing plate 100, and spaces between adjacent ones of the convex portions $\mathbf{10}d_1$, $\mathbf{10}d_2$ . . . form concave portions 10*c* . . . . In regions of the convex portions $\mathbf{10}d_1$, $\mathbf{10}d_2$, . . . , clear element layers 102, 103, 104, and 105 are layered on the light diffusion plate 100. A laminated body of the clear element layers 102-105 is referred to as a laminated clear layer 101.

A color layer 106 is layered so as to cover a top surface and side surfaces of the laminated clear layer 101. In the drawings, the color layer 106 is schematically shown, but in detail the color layer 106 is formed by full color printing using four colors of ink: cyan (C), magenta (M), yellow (Y), and black (K). UV-curable ink is used, and the ink is applied by using an inkjet device.

A light adjustment layer 107 is formed so as to cover a top surface of the color layer 106. The light adjustment layer 107 is formed so as to also cover a surface of the light diffusion plate 100 in the concave portion 10*c*. The light adjustment layer 107 is formed in a dot pattern by using UV curable ink and an inkjet device is for ink application. In forming the light adjustment layer 107, a primer may be pre-applied on a surface of an underlying layer in consideration of ink affinity of the underlying layer.

Regarding the printed matter 10, light $L_1$ is transmitted from the back surface 10*b* to the front surface 10*a* when the LED 21 is lit, and light $L_2$ incident from the front surface 10*a* is reflected to be emitted towards an observer when the LED 21 is not lit.

As shown in FIG. 2, according to the present embodiment, the clear element layers 102-105 each have a trapezoidal shape in cross section, and are layered in a pyramid from a Z axis direction lower side.

However, cross section shape of each layer is not limited to this example, and a portion of layers may have the same cross section size as layers above and below, or all layers may have the same cross section size.

However, by layering in a pyramid shape as shown in FIG. 2, the color layer 106 can also be formed on a side surface of the laminated clear layer 101, and an image formed all over an entire region visible to a viewer.

Further, by rounding upper corners of each layer, it is possible to improve image quality as perceived by a viewer.

3. Progress of Light Incident on Printed Matter 10 and Role Played by Light Adjustment Layer 107

Figure 3C:
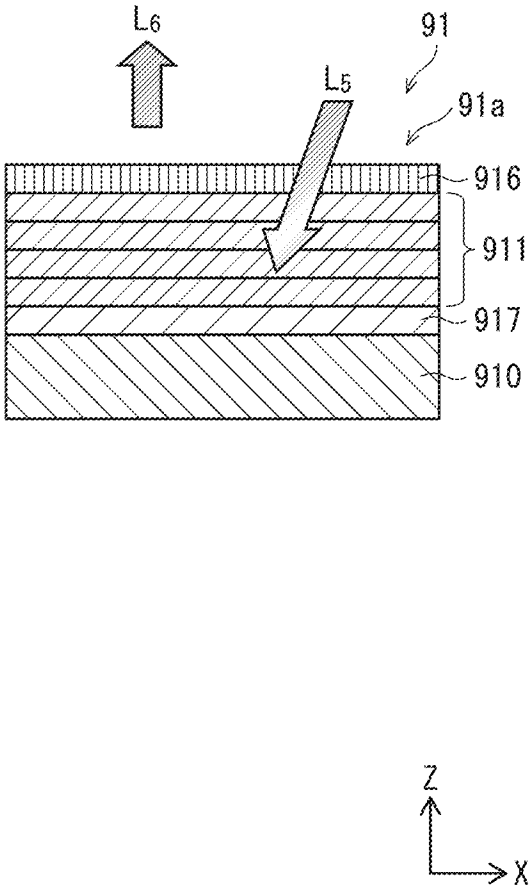
FIG. 3C is a schematic diagram showing progression of light incident on printed matter 91 pertaining to comparative example 1 from front surface 91*a*.
Figure 3B:
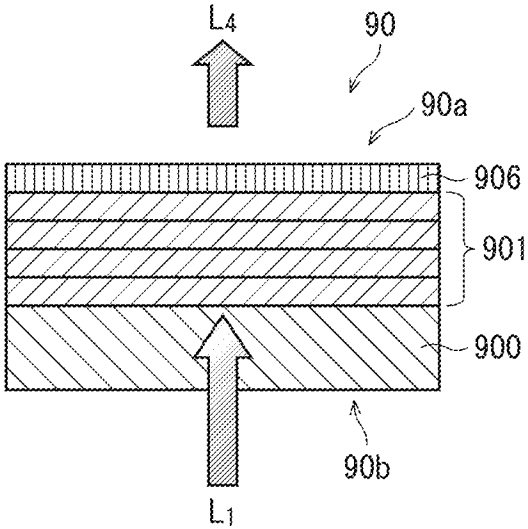
FIG. 3B is a schematic diagram showing progression light incident on printed matter 90 pertaining to comparative example 1 from back surface 90*b*.
Figure 3A:
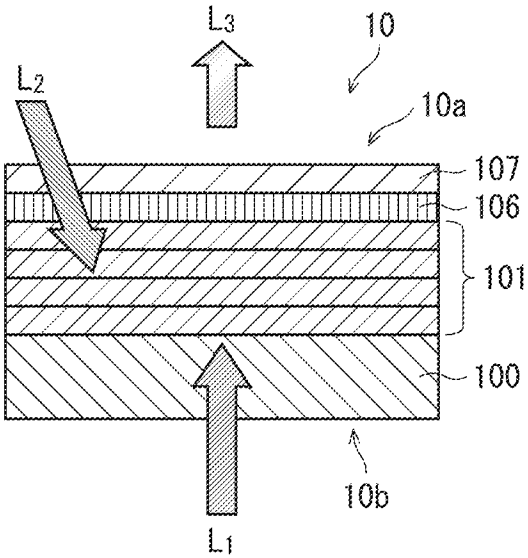
FIG. 3A is a schematic diagram showing progression of light incident on printed matter 10 from back surface 10*b*.

Progress of light incident on the printed matter 10 and the role played by the light adjustment layer 107 are described with reference to FIG. 3A, FIG. 3B, and FIG. 3C. FIG. 3A shows a case of the present embodiment, and FIG. 3B and FIG. 3C show cases of comparative examples.

As shown in FIG. 3A, with respect to the printed matter 10, when the LED 21 is lit, light $L_1$ incident from the back surface 10*b* is transmitted through the color layer 106 and the light adjustment layer 107 and emitted (emitted light $L_3$). On the other hand, when the LED 21 is not lit, light $L_2$ incident from the front surface 10*a* is reflected at a boundary or the like below the color layer 106 in the Z axis direction, and reflected light is transmitted through the color layer 106 and the light adjustment layer 107 and emitted (emitted light $L_3$).

Here, the light adjustment layer 107 has a function of shielding a portion of light transmitted therethrough, while another portion of light is transmitted therethrough. The light adjustment layer 107 pertaining to the present embodiment is faulted in dot pattern and functions to balance amounts of transmitted and reflected light. More specific configuration is described later.

Further, the laminated clear layer 101 is formed in order to form the convex portions 10*d*1, 10*d*2, but particularly for transmitted light, light for which yellow coloring occurs tends to be emitted.

However, according to the printed matter 10 pertaining to the present embodiment, the light adjustment layer 107 is formed on the color layer 106, and therefore yellow coloring caused by the laminated clear layer 101 can be suppressed, and even when an image is perceived by transmitted light, emitted light $L_3$ that is transmitted through the color layer 106 exhibits excellent color reproduction. In particular, when the color layer 106 is primarily a pale color, excellent color reproduction is exhibited.

As shown in FIG. 3B, printed matter 90 is assumed to have a configuration in which a laminated clear layer 901 and a color layer 906 are layered in this order on a substrate 900 and a light adjustment layer is not provided above the color layer 906 in the Z axis direction. When light $L_1$ is incident from a back surface 90*b* of the printed matter 90, transmitted through the printed matter 90, and emitted as light $L_4$, yellow coloring occurs due to transmission through the laminated clear layer 901. Although not illustrated, it is thought that yellowing occurs even when an image is perceived by reflected light, but to a lesser degree than in a case of perception by transmitted light. Although the reason for this has not been clearly elucidated, an inventor found that in the case of reflected light, reflection also occurs at a top portion of the laminated clear layer and in such a case the number of boundaries between clear element layers that light passes through is low, while in the case of transmitted light absorption of a portion of a wavelength region is high due to light refraction and the like occurring as the light passes through all boundaries between clear element layers in the laminated clear layer.

Accordingly, in the case of the comparative example 1 shown in FIG. 3B, color tone of an image perceived by an observer is different between transmitted light and reflected light. In other words, it may be considered that image quality is reduced, particularly when an image is perceived by a viewer via transmitted light.

Further, as shown in FIG. 3C, printed matter 91 is assumed to use a medium such as paper as a substrate 910, on which a white reflective layer 917, a laminated clear layer 911, and a color layer 916 are formed in this order. Light $L_5$ incident on the printed matter 91, configured as above, from above in the Z axis direction is mostly reflected by the white reflective layer 917, is transmitted through the color layer 916, and emitted from a front surface 91*a* (light $L_6$). Perception of an image by transmitted light is not intended for comparative example 2, and therefore a function of the white reflective layer 917 is to reflect as much as possible of light $L_5$ that is incident from above. Thus, even if the printed matter 91 of comparative example 2 is irradiated by light from a back side thereof, light is not substantially transmitted and an image via transmitted light cannot be perceived by a viewer. That is, the white reflective layer 917 provided for the purpose of light reflection reflects not only light from above in the Z axis direction, but also light from below in the Z axis direction.

4. Configuration of Layer Thicknesses and Light Adjustment Layer 107

(Layer Thicknesses)

Layer thicknesses of each layer are described with reference to FIG. 4A as an example of the present embodiment.

Figure 4A:
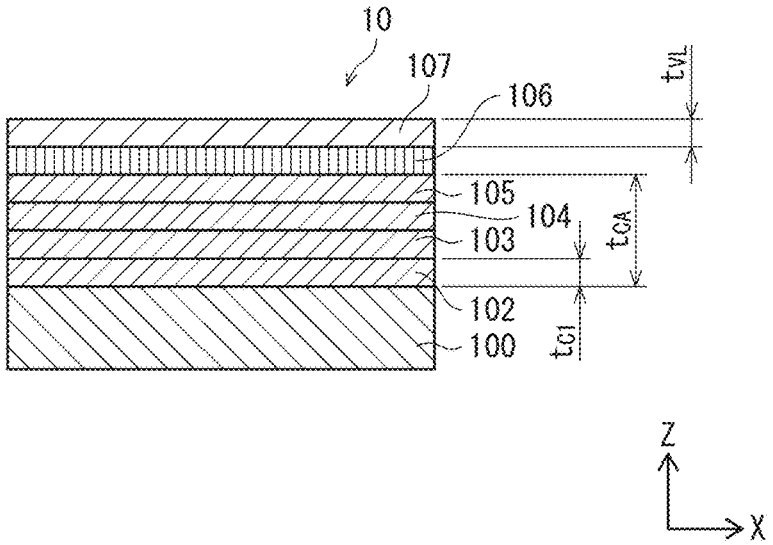
FIG. 4A is a schematic cross section showing configuration of printed matter 10.

As shown in FIG. 4A, according to the printed matter 10 pertaining to the present embodiment, a total thickness $t_{CA}$ of the laminated clear layer 101 is approximately 0.08 mm. A layer thickness $t_{C1}$ of each of the clear element layers 102-105 that constitute the laminated clear layer 101 is approximately 0.02 mm. According to the present embodiment, the laminated clear layer 101 is a layered body comprising the four layers of the clear element layers 102-105, but the number of layers can be changed according to an image to be expressed. Further, thicknesses of the clear element layers need not be the same as each other, and may be different from each other.

A thickness $t_{VL}$ of the light adjustment layer 107 formed on the color layer 106 is from 0.010 mm to 0.030 mm, or more preferably from 0.010 mm to 0.020 mm (for example, 0.020 mm). The layer thickness $t_{VL}$ of the light adjustment layer 107 can be appropriately determined in view of such factors as an amount of transmitted light and thickness of the laminated clear layer.

Figure 4B:
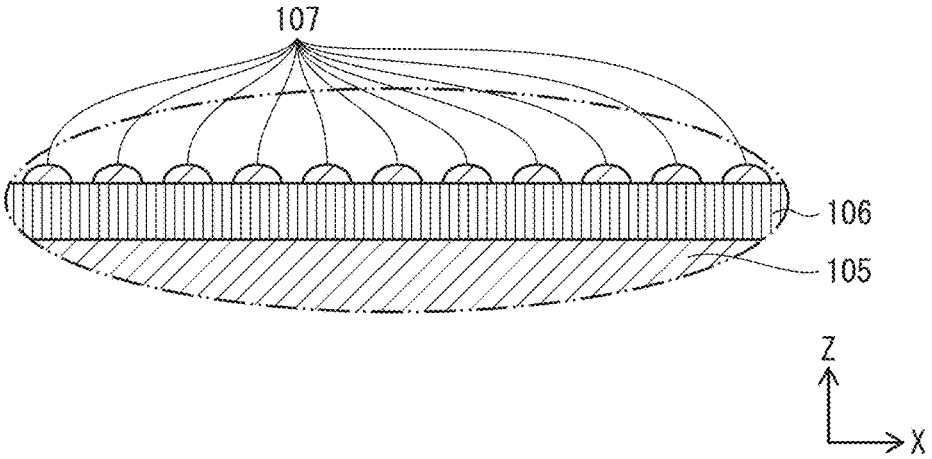
FIG. 4B is a schematic cross section showing a portion of light adjustment layer 107 and color layer 106 thereunder.

Next, as shown in FIG. 4B, the light adjustment layer 107 pertaining to the present embodiment is formed in a dot pattern on a surface of the color layer 106 thereunder. The light adjustment layer 107 includes white pigment. The light adjustment layer 107 is considered to contain a resin component in addition to the white particles, and is bonded to a surface of the color layer 106 by the resin component. As specific examples of the resin component, materials such as an epoxy resin material, a urethane resin material, a polyester resin material, or the like can be used.

In the light adjustment layer 107, white particles are not aggregated and are in a dispersed state.

Figure 4C:
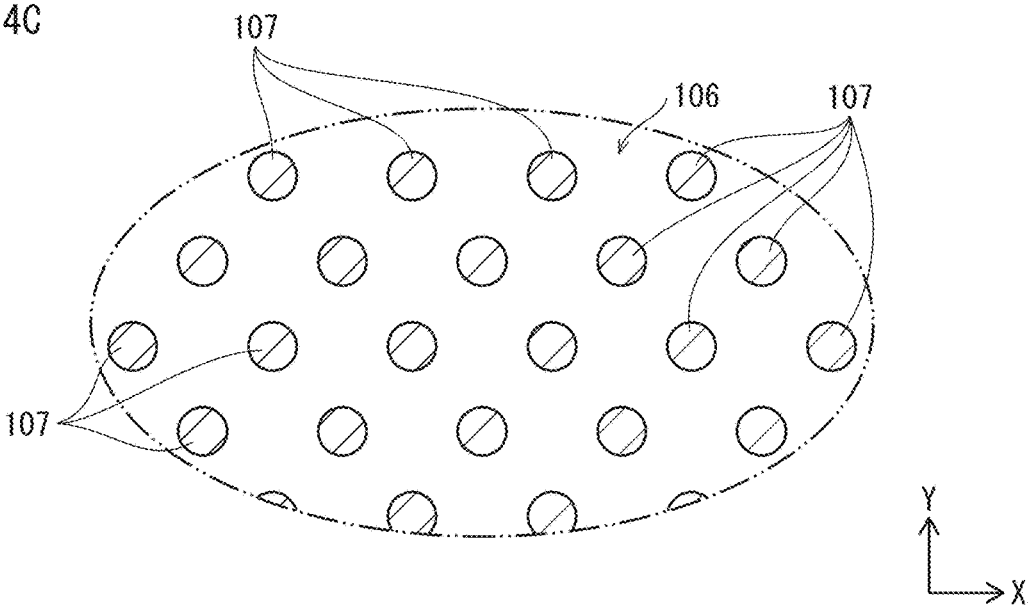
FIG. 4C is a schematic plan view of light adjustment layer 107 and color layer 106.

As shown in FIG. 4B and FIG. 4C, the light adjustment layer 107 is formed to cover a portion of a surface of the color layer 106 (formed in a dot pattern), and is adjusted to cover a surface area ratio from 2% to 50% of the surface of the color layer 106. The surface area ratio covered by the light adjustment layer 107 is more preferably from 20% to 30% of the surface of the color layer 106. For example, according to the present embodiment, the surface area ratio is 30%.

5. Application Example

An application example of the printed matter 10 pertaining to the present embodiment and the illumination device 1 including same is described with reference to FIG. 5.

Figure 5:
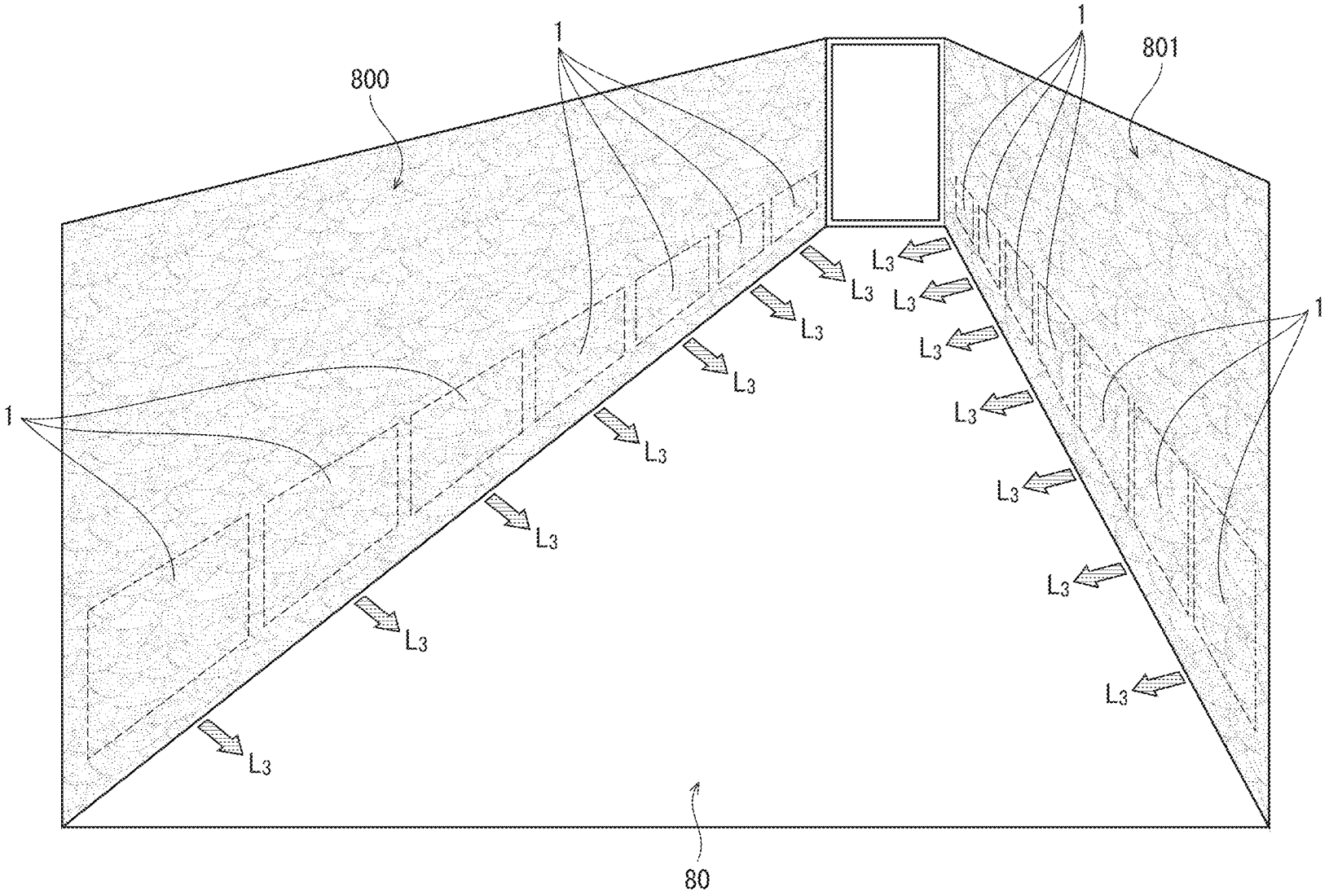
FIG. 5 is a schematic diagram showing a use example of illumination device 1.

As shown in FIG. 5, a pattern is formed on side walls 800, 801 disposed either side of a passage 80. Further, a plurality of the illumination device 1 is embedded in lower portions of the side walls 800, 801. Each of the illumination devices 1 has a configuration as described above, and when the LED 21 is lit, emits light $L_3$.

As shown in FIG. 5, patterning (image and convexity/concavity) of the illumination devices 1 is substantially the same as patterning (image and convexity/concavity) of the side walls 800, 801 other than the illumination devices 1. That is, regardless of whether the LED 21 is lit or not, a person passing through the passage 80 can feel as if portions of the side walls 800, 801 are glowing, and when the LED 21 is not lit, it is difficult to notice the existence of the illumination device 1.

Note that although surface patterning of the printed matter 10 in the illumination device 1 is made to match surface patterning of the side walls 800, 801 in this application example, matching is not necessarily required. For example, a picture can be formed on a surface of the printed matter in the illumination device. When the LED is not lit it is simply perceived as a picture hung on a wall, and when the LED is lit it is perceived as a backlit picture.

6. Method of Manufacturing Printed Matter 10

A method of manufacturing the printed matter 10 is described with reference to FIG. 6.

(1) Imaging and Scanning

Figure 6:
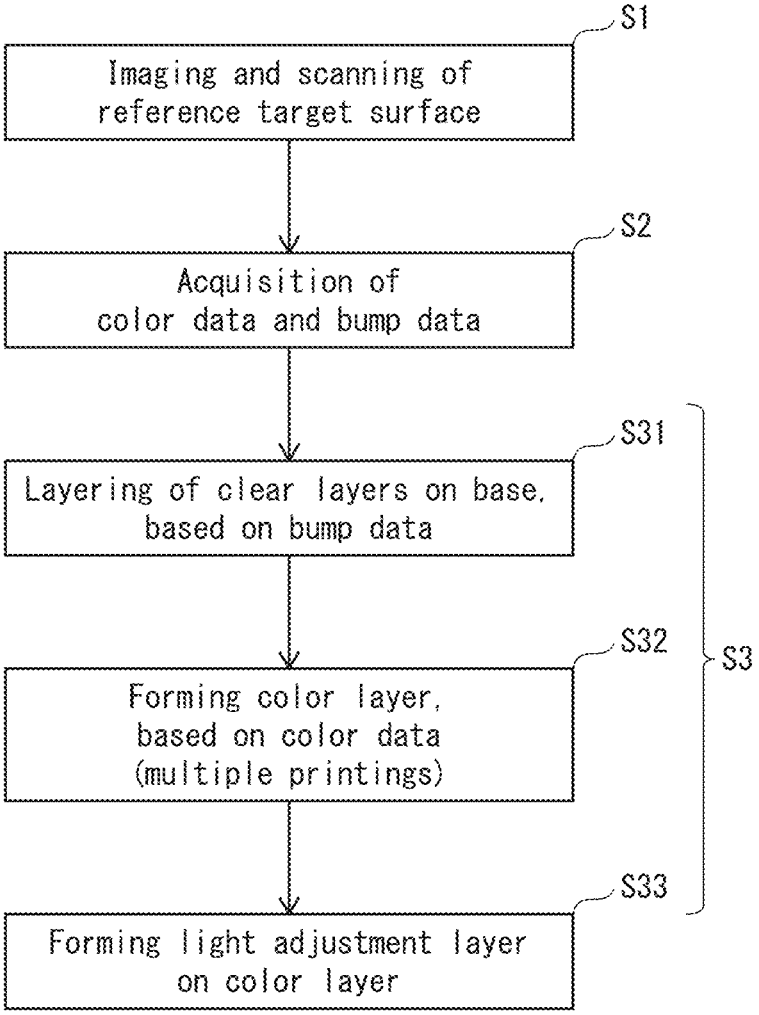
FIG. 6 is a process chart schematically showing a method for manufacturing printed matter 10.

As shown in FIG. 6, a reference target surface to be printed is imaged and scanned (step S1 in FIG. 6). More specifically, for example, a charge-coupled device (CCD) camera, a complementary metal-oxide-semiconductor (CMOS) camera, or the like images a surface portion of an object to be reproduced, and surface irregularities are measured using a laser displacement measuring device or the like. At this time, imaged positions and positions of measured surface irregularities are associated with each other.

(2) Acquiring Color Data and Bump Data

As shown in FIG. 6, the four colors CMYK and height of convex portions (bump data) are calculated for each position from data obtained by the imaging and scanning, and are stored in a memory or the like (step S2 in FIG. 6).

(3) Printing (3-1) Layers of Clear Element Layers

Bump data is sequentially read from the memory and clear ink is applied and dried to layer clear element layers on/above a top surface of the light diffusion plate (substrate) 100 according to the bump data (step S31 in FIG. 6). According to the description above, the laminated clear layer 101 is configured to have four clear element layers 102-105, but the number of layers is changed according to the bump data.

(3-2) Forming Color Layer

Color data is sequentially read from the memory, and the color layer 106 is formed so as to cover a top surface and side surfaces of the laminated clear layer 101 (step S32, FIG. 6). The color layer 106 is forming, for example, by using an inkjet device to apply ultraviolet (UV) curable ink containing a pigment for each color and curing the ink by using UV irradiation.

When a more vivid color is to be expressed, two or more color layers can be formed.

(3-3) Forming Light Adjustment Layer

Next, the light adjustment layer 107 is formed so as to cover the color layer 106 and an exposed surface of the light diffusion plate 100 (step S33 of FIG. 6). In order to form the light adjustment layer 107, for example, UV curable ink containing white particles made of a white pigment (for example, titanium oxide) is applied by using an inkjet device and hardened by UV irradiation. As described above, it is also possible to preliminarily apply a primer to a surface of an underlying layer in consideration of ink affinity of the underlying layer.

Thus, printing (step S3 of FIG. 6) is completed and the printed matter 10 is completed.

Embodiment 2

Figure 7A:
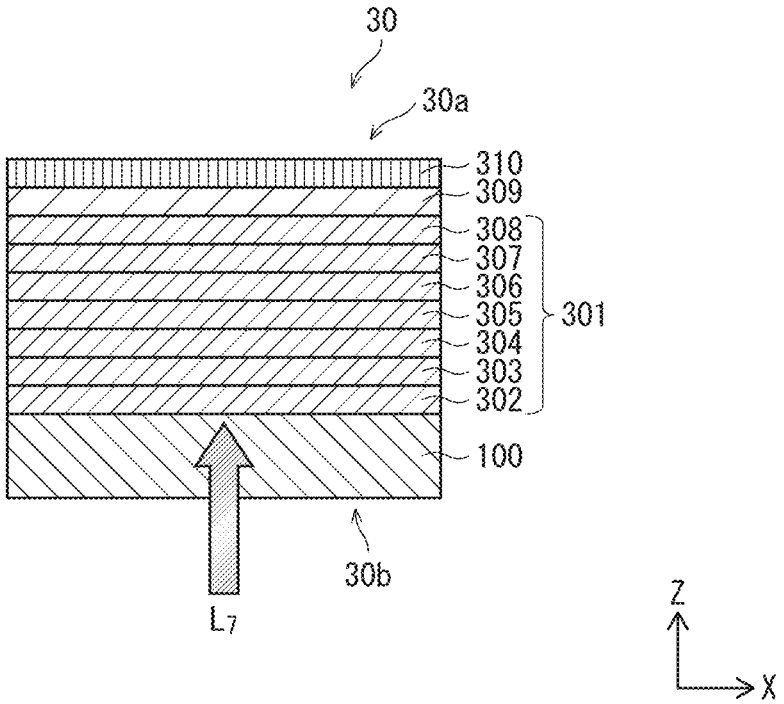
FIG. 7A and FIG. 7B are schematic cross sections showing configuration of printed matter 30 pertaining to Embodiment 2.

Configuration of printed matter 30 pertaining to Embodiment 2 is described with reference to FIG. 7A and FIG. 7B. FIG. 7A corresponds to FIG. 3A of Embodiment 1, and other configurations of the printed matter 30 can be the same as those of Embodiment 1.

As shown in FIG. 7A, a laminated clear layer 301, which is a layered body of seven clear element layers 302, 303, 304, 305, 306, 307, 308, a light adjustment layer 309, and a color layer 310 are layered in this order in the Z axis direction from the top surface of the light diffusion plate 100. Points of difference from Embodiment 1 are that the number of clear element layers 302-308 of the laminated clear layer 301 is seven, and the light adjustment layer 309 is disposed below the color layer 310.

Further, each of the clear element layers 302-308 of the laminated clear layer 301 have a thickness from 0.010 mm to 0.030 mm, for example.

Although not illustrated, the backlight 20 is disposed on a back surface 30*b* of the printed matter 30 pertaining to the present invention, and when the LED 21 is lit, incident light $L_7$ is transmitted through the printed matter 30 and emitted from a front surface 30*a*.

Here, in terms of surface area ratio in plan view, the light adjustment layer 309 of the present embodiment is formed so as to cover from 2% to 50% (for example, 30%) of the surface of the clear element layer 308 thereunder. More specifically, the light adjustment layer 309 is forming in a dot pattern, as in Embodiment 1.

Figure 7B:
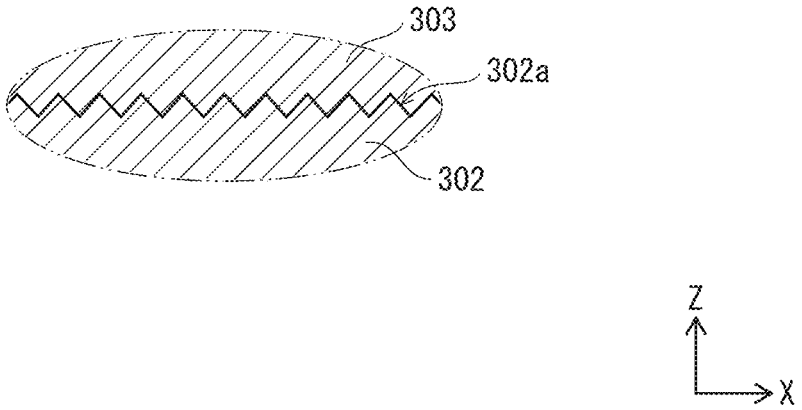

According to the printed matter 30 pertaining to the present embodiment, even when surface irregularity 302*a* is present at surfaces of the clear element layers 302-308 as shown in FIG. 7B, influence of irregular reflection caused by the unevenness 302*a* can be suppressed by the light adjustment layer 309. That is, if light progressing in an oblique direction angled away from the Z axis direction due to irregular reflection is directly incident on the color layer 310, wavelength of emitted light changes due to a long optical path.

However, by interposing the light adjustment layer 309 between the laminated clear layer 301 and the color layer 310, it is possible to change an optical path of light progressing at an oblique angle to be directed upward in the Z axis direction. This is due to a high probability that light incident on the light adjustment layer 309 in an oblique direction irradiates white particles in the light adjustment layer 309.

As described above, according to printed matter pertaining to the present embodiment, it is possible to suppress influence of irregular reflection caused by the laminated clear layer 301 when light $L_7$ from a backlight is incident on the laminated clear layer 301, and the printed matter pertaining to the present embodiment is appropriate in situations such as when the number of clear element layers is increased to adopt an image having a sense of depth, such as a photograph.

Note that although the number of clear element layers of the laminated clear layer 301 is seven according to the present embodiment, eight or more layers (for example, 10 layers) may be used. Thus, a sense of image depth can be increased.

Embodiment 3

Figure 8A:
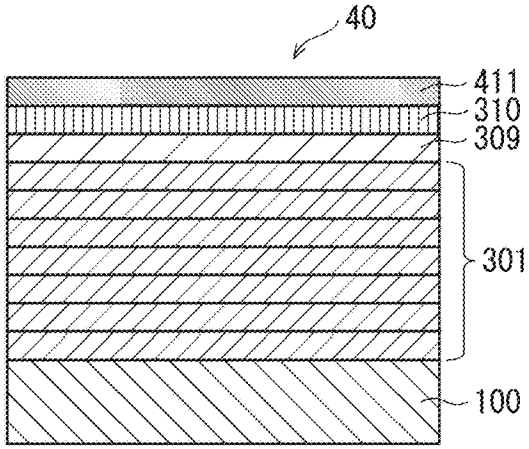
FIG. 8A is a schematic cross section showing configuration of printed matter 40 pertaining to Embodiment 3.

Configuration of printed matter 40 pertaining to Embodiment 3 is described with reference to FIG. 8A. FIG. 8A also corresponds to FIG. 3A of Embodiment 1, and other configurations of the printed matter 40 can be the same as those of Embodiment 1.

As shown in FIG. 8A, according to the printed matter 40, the laminated clear layer 301, which is a layered body of seven clear element layers, the light adjustment layer 309, the color layer 310, and a protective layer 411 are layered in this order in the Z axis direction from the top surface of the light diffusion plate 100. A point of difference from Embodiment 2 is that the protective layer 411 covers a top surface of the color layer 310.

The protective layer 411, for example, is formed using a hard resin material. For example, polypropylene (PP), acrylic resin (PMMA), styrene acrylonitrile resin (SAN), acrylonitrile butadiene styrene (ABS) resin, polycarbonate (PC), or the like can be used.

Here, density of the light adjustment layer 309 is also from 2% to 50% (for example, 30%). More specifically, the light adjustment layer 309 is formed in a dot pattern, as in Embodiment 1.

As in the present embodiment, when the color 310 is covered by the protective layer 411, the color layer 310 is protected when a person touches a printed matter surface, and deterioration of the color layer 310, the light adjustment layer 309, and the laminated clear layer 301 due to moisture and the like can be suppressed. In particular, even in a case in which printed matter to which an ink embossing process is applied is touched by a person, the color layer 310 can be reliably protected.

With respect to printed matter that does not include a color layer, it is also possible to protect a light adjustment layer, laminated clear layer, etc., covered by a protective layer by disposing the protective layer on a topmost surface of a layered structure.

Modifications

Configuration of printed matter 45 pertaining to a modification is described with reference to FIG. 8B. The present modification is similar to the printed matter 40 pertaining to Embodiment 3, and configuration of portions that are not illustrated is the same as in Embodiment 1, as in Embodiment 3.

Figure 8B:
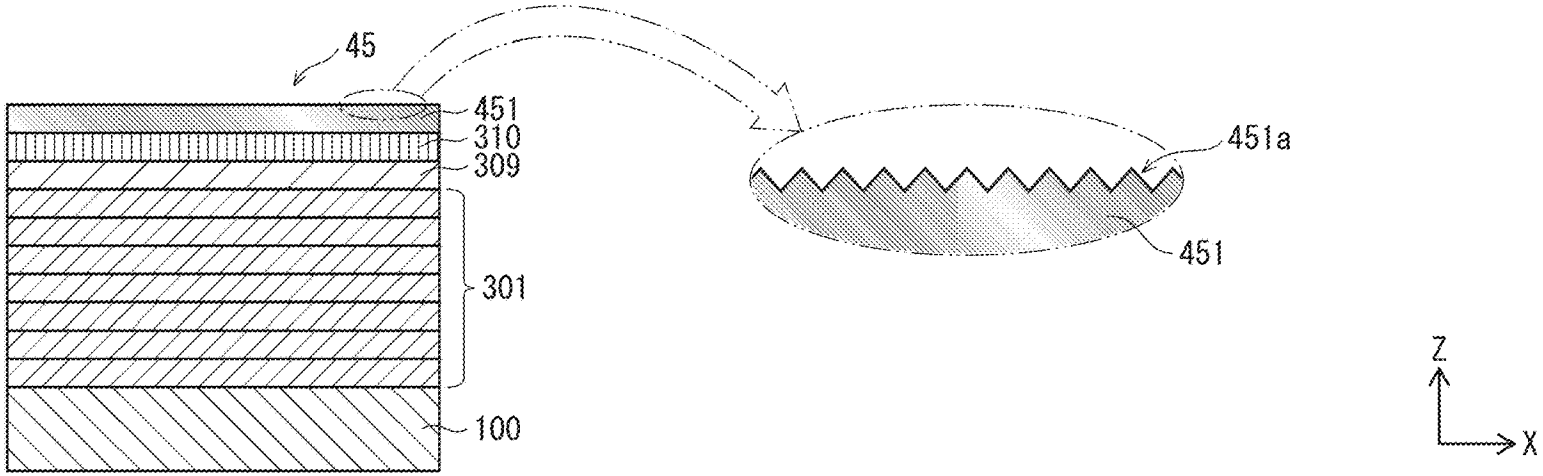
FIG. 8B is a schematic cross section showing configuration of printed matter 45 pertaining to a modification.

As shown in FIG. 8B, for the printed matter 45 pertaining to the present modification, configuration of laminated clear layer 301, the light adjustment layer 309, and the color layer 310 layered on a top surface of the light diffusion plate 100 is the same as that of the printed matter 40 pertaining to Embodiment 3. The point that a protective layer 451 is layered on the color layer 310 is also similar.

However, according to the present modification, as shown in the enlargement of FIG. 8B, a top surface of the protective layer 451 is processed to be irregular (surface irregularities 451*a*), thereby forming a matt finish. It is not always necessary to provide the surface irregularities 451*a* of the protective layer 451 to the entire surface of the protective layer 451, and in consideration of an image, both a glossy protective layer 411 as shown in FIG. 8A and a matt protective layer 451 as shown in FIG. 8B can be provided.

Here, density of the light adjustment layer 309 is also from 2% to 50% (for example, 30%). More specifically, the light adjustment layer 309 is formed in a dot pattern, as in Embodiment 1.

According to the printed matter 45 provided with the protective layer 451, the color layer 310 can be protected, and an texture of an image formed by the color layer 310 can be increased by the matt finish of the protective layer 451.

Effects obtained by disposition of the light adjustment layer 309 are as described above.

Embodiment 4

Figure 9C:
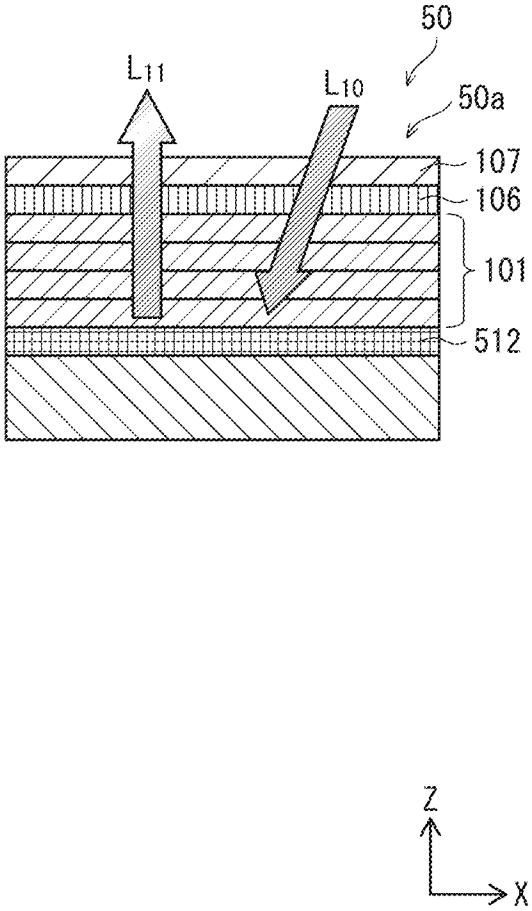
FIG. 9C is a schematic diagram showing progression of light incident on printed matter 50 from a front thereof.
Figure 9B:
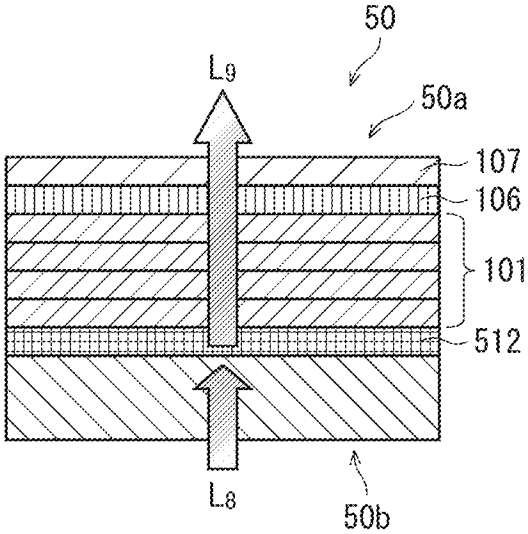
FIG. 9B is a schematic diagram showing progression of light incident on printed matter 50 from a back surface thereof.
Figure 9A:
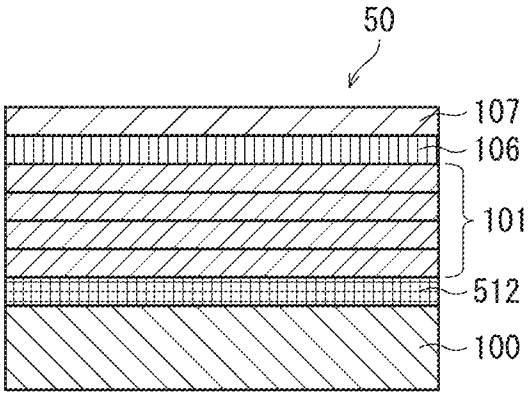
FIG. 9A is a schematic cross section showing a configuration of printed matter 50 pertaining to Embodiment 4.

Configuration of printed matter 50 pertaining to Embodiment 4 is described with reference to FIG. 9A, FIG. 9B, and FIG. 9C. In FIG. 9A, FIG. 9B, and FIG. 9C, parts having the same reference signs as above have the same configuration as described above, and description thereof is not repeated below. Further, configuration of other parts that are not illustrated is the same as in Embodiment 1.

As shown in FIG. 9A, according to the printed matter 50 pertaining to the present embodiment, a second light adjustment layer 512 is disposed between the top surface of the light diffusion plater 100 and the laminated clear layer 101. Configurations of the laminated clear layer 101, the color layer 106, and the light adjustment layer 107 are the same as that of the printed matter 10 pertaining to Embodiment 1.

Configuration of the second light adjustment layer 512 interposed between the light diffusion plate 100 and the laminated clear layer 101 is essentially the same as that of the light adjustment layer 107 shown in FIG. 4B. However, density of the second light adjustment layer 512 (surface area ratio in plan view of the surface of the light diffusion plate 100 covered by the second light adjustment layer 512) is from 2% to 50% and is set to be higher than that of the light adjustment layer 107.

The density of the second light adjustment layer 512 is set higher than that of the light adjustment layer 107 disposed above the second light adjustment layer 512 in consideration of reflection of light incident from above as a function of the second light adjustment layer 512. However, if the density of the second light adjustment layer 512 is made higher than 50%, much of light from the backlight 20 incident thereon from the back surface of the light diffusion plate 100 is also blocked, so care must be taken. With respect to a partial region in plan view, when transmitted light is to be completely shielded, density can be higher than 50% (for example, 100%). This can be considered in relation to an image.

Next, with reference to FIG. 9B and FIG. 9C, progression of light is described in a case in which the LED 21 of the backlight 20 is lit, and a case in which the LED 21 is not lit.

First, as shown in FIG. 9B, when the LED 21 of the backlight 20 is lit, light $L_8$ from a back surface 50*b* of the printed matter 50 is incident thereon. Incident light is transmitted through the second light adjustment layer 512, the laminated clear layer 101, the color layer 106, and the light adjustment layer 107, and is emitted from a front surface 50*a* (light $L_9$). A viewer perceives an image via the light $L_9$. Here, as described above, if density of the second light adjustment layer 512 is too high, attenuation of transmitted light becomes too high, and therefore a range from 2% to 50% is required. In terms of attenuation of transmitted light, is preferable to set the density of the second light adjustment layer 512 from 25% to 35% (for example, 30%).

Next, as shown in FIG. 9C, when the LED 21 of the backlight 20 is not lit, light $L_{10}$ from the front surface 50*a* is incident, and the incident light $L_{10}$ is reflected upwards in the Z axis direction by the second light adjustment layer 512. Light reflected by the second light adjustment layer 512 is transmitted through the laminated clear layer 101, the color layer 106, and the light adjustment layer 107, and is emitted from the front surface 50*a* (light $L_{11}$). A viewer can perceive an image via the light $L_{11}$.

According to the printed matter 50 pertaining to the present embodiment, by adjusting density of the second light adjustment layer 512, high image quality can be ensured both in a case in which the LED 21 of the backlight 20 is lit and a case in which the LED 21 is not lit, i.e., both when a viewer perceives an image via transmitted light and when a viewer perceived an image via reflected light.

The effect obtained by the upper-side disposition of the light adjustment layer 107 is the same as that of the printed matter 10 pertaining to Embodiment 1.

By using the configuration of the printed matter 50 pertaining to the present embodiment it is possible to realize a higher image quality both in a case in which an image is perceived via transmitted light and in a case in which an image is perceived via reflected light.

Disposition of the second light adjustment layer 512 is not necessarily required to be between the light diffusion plate 100 and the laminated clear layer 101, and may be between any of the clear element layers 102-105 of the laminated clear layer 101. Further, the number of clear element layers of the laminated clear layer can also be appropriately changed in consideration of a relationship with an image.

Embodiment 5

Figure 10:
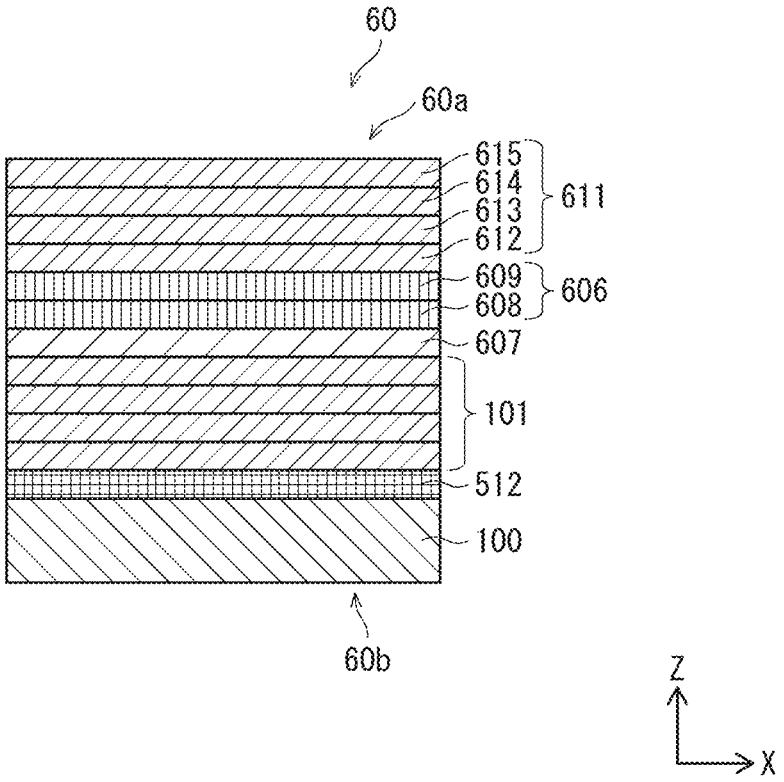
FIG. 10 is a schematic cross section showing configuration of printed matter 60 pertaining to Embodiment 5.

Configuration of printed matter 60 pertaining to Embodiment 5 is described with reference to FIG. 10. In FIG. 10, parts assigned the same reference signs as in Embodiment 4 are configured to be the same as those of Embodiment 4, and are not described below. Further, configuration of other parts that are not illustrated is the same as in Embodiment 1.

As shown in FIG. 10, according to the printed matter 60 pertaining to the present embodiment, the second light adjustment layer 512, the laminated clear layer 101, and a light adjustment layer 607 are layered in this order on the top surface of the light diffusion plate 100. The light adjustment layer 607 has the same configuration as the light adjustment layer 107 of Embodiment 1 or 4, and the second light adjustment layer 512 is the same as in Embodiment 4.

According to the printed matter 60, a laminated color layer 606 made of two color element layers 608, 609 is formed above the light adjustment layer 607 in the Z axis direction, and a laminated clear layer 611 made of four color element layers 612, 613, 614, 615 is layered thereon.

According to the printed matter 60 pertaining to the present embodiment, the laminated color layer 606 made of the two color element layers 608, 609 is used in order to make color depth more noticeable for positions that are to be expressed with deep color.

The laminated clear layer 611 is further framed on the laminated color layer 606 in order to further enhance texture of a deep color part of an image.

According to the present embodiment, densities of the light adjustment layer 607 and the second light adjustment layer 512 are each from 2% to 50%, in terms of surface area ratio in plan view.

According to the printed matter 60 that has the above configuration, high image quality can be realized both in a case in which light is incident from a back surface 60*b* and a viewer perceives an image via transmitted light and in a case in which light is incident from a front surface 60*a* and a viewer perceives an image via reflected light. Further, according to the printed matter 60 pertaining to the present embodiment, texture at deep color positions can be increased by the laminated color layer 606 by use of the configuration shown in FIG. 10.

Embodiment 6

Configuration of printed matter 70 pertaining to Embodiment 6 is described with reference to FIG. 11A. In FIG. 11A, parts assigned the same reference signs as in Embodiment 1 are configured to be the same as those of Embodiment 1.

As shown in FIG. 11A, according to the printed matter 70 pertaining to the present embodiment, the laminated clear layer 101, and the light adjustment layer 107 are layered in this order on the top surface of the light diffusion plate 100. The light adjustment layer 107 has the same configuration as in Embodiment 1. The printed matter 70 pertaining to the present embodiment is different from the printed matter 10 pertaining to Embodiment 1 in that a color layer is not provided, and the light adjustment layer 107 is layered directly on the laminated clear layer 101.

Density of the light adjustment layer 107 pertaining to the present embodiment is also from 2% to 50%, in terms of surface area ratio in plan view.

The printed matter 70 having the configuration described above can also achieve high image quality by suppressing yellowing when light is incident from a back surface and an image (a white image) is perceived via transmitted light. Thus, high image quality can be achieved for an image formed by using the printed matter 70 both when perceived via transmitted light and when perceived via reflected light.

Embodiment 7

Configuration of printed matter 80 pertaining to Embodiment 7 is described with reference to FIG. 11B.

Figure 11B:
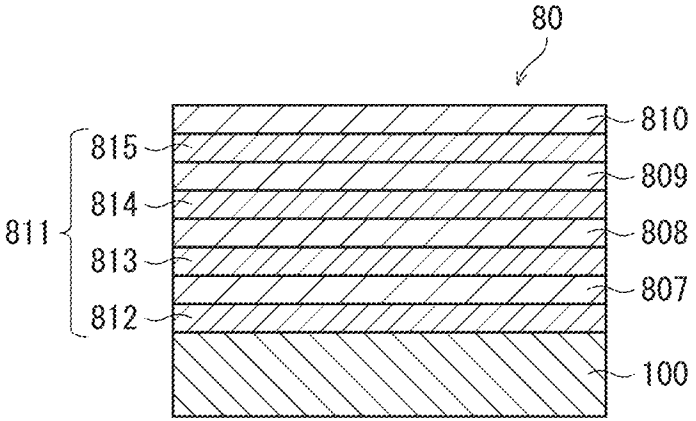
FIG. 11B is a schematic cross section showing configuration of printed matter 80 pertaining to Embodiment 7.
Figure 11A:
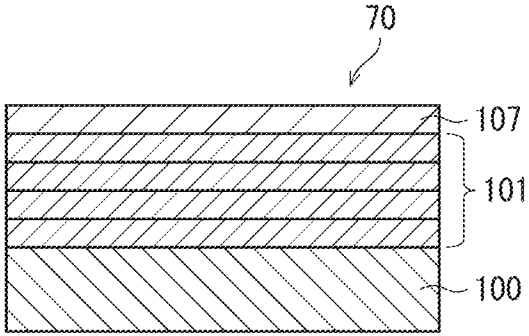
FIG. 11A is a schematic cross section showing configuration of printed matter 70 pertaining to Embodiment 6.

As shown in FIG. 11B, according to the printed matter 80 pertaining to the present embodiment, a clear layer 812, a light adjustment layer 807, a clear layer 813, a light adjustment layer 808, a clear layer 814, a light adjustment layer 809, a clear layer 815, and a light adjustment layer 810 are layered in this order. In other words, according to the printed matter 80, the light adjustment layers 807, 808, 809 are interposed between the four layers of a laminated clear layer 811.

Density of the light adjustment layers 807-810 is 7% for the light adjustment layers 807, 808, 809 and 10% for the light adjustment layer 810. Thickness of each of the light adjustment layers 807-810 is from 0.010 mm to 0.030 mm, or more preferably from 0.010 mm to 0.020 mm (for example, 0.020 mm).

Here, a total of densities of the light adjustment layers 807-810 of the printed matter 80 is 31% (7%×3+10%), and this is considered to be the "density of the light adjustment layer".

The printed matter 80 having the configuration described above can also achieve high image quality by suppressing yellowing when light is incident from a back surface and an image (a white image) is perceived via transmitted light. Thus, high image quality can be achieved for an image formed by using the printed matter 80 both when perceived via transmitted light and when perceived via reflected light.

Further, according to the printed matter 80 pertaining to the present embodiment, a viewer can experience more sense of depth due to the alternation of the clear layers 812-815 and the light adjustment layers 807-810. This is attributable to the fact that dots of the light adjustment layers 807-810 are slighted shifted in an X-Y plane direction, and it is considered that a sense of depth is imparted due to refraction of light in oblique directions due to misalignment of the dots. Misalignment of the dots of the light adjustment layers 807-810 may be provided intentionally at the time of manufacture or may be achieved by using accuracy variation of an inkjet device.

Light Transmission of Printed Matter

Transmission of light incident on a back surface of printed matter is described with reference to FIG. 12A, 12B, 12C, 12D, and FIG. 13A, 13B, 13C, 13D. FIG. 12A, 12B, 12C, 12D, and FIG. 13A, 13B, 13C, 13D show transmission states of the printed matter 70 pertaining to Embodiment 6 and the printed matter 80 pertaining to Embodiment 7.

1. Printed Matter 70

Figure 12A:
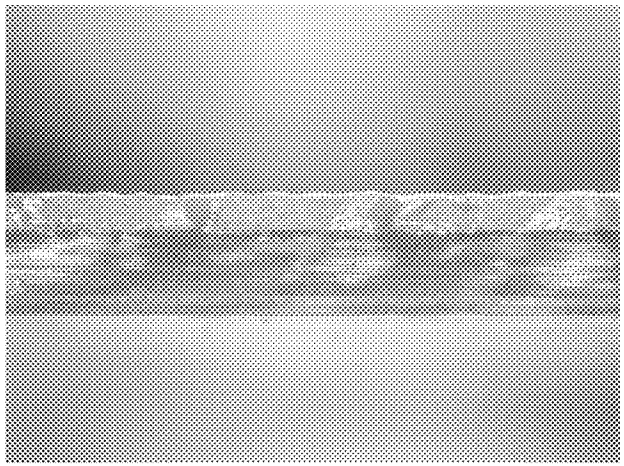
FIG. 12A is a vertical cross section image of printed matter 70 when light is incident on a back surface thereof.
Figure 12B:
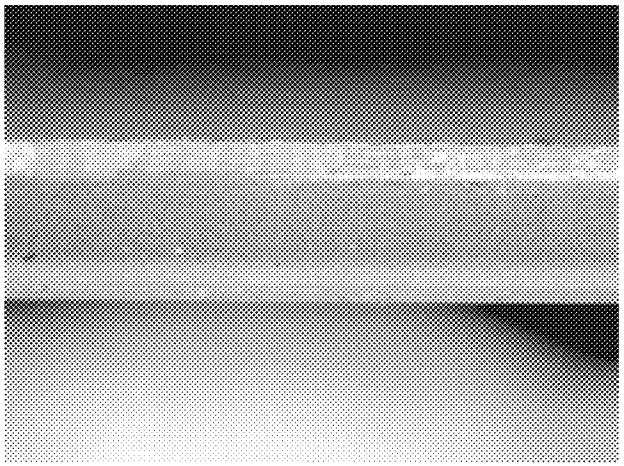
FIG. 12B is a vertical cross section image of printed matter 80 when light is incident on a back surface thereof.
Figure 12C:
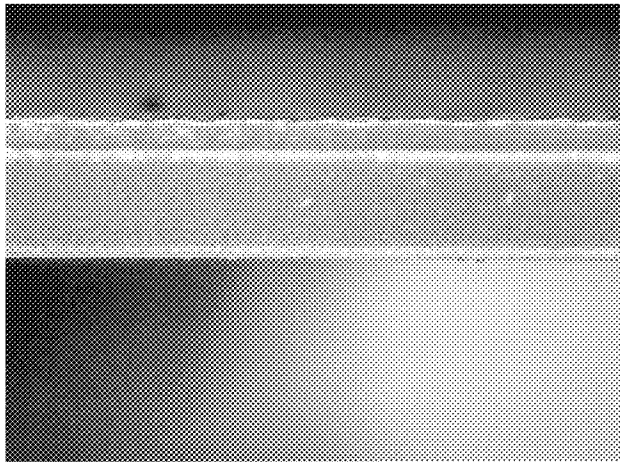
FIG. 12C is a transverse cross section image of printed matter 70 when light is incident on a back surface thereof.
Figure 13B:
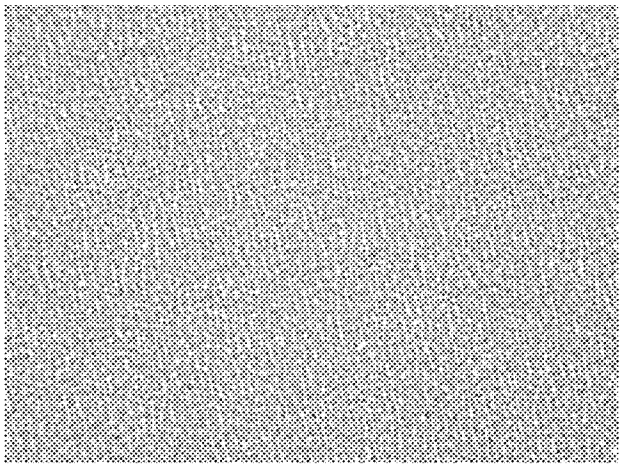
FIG. 13B is an image captured from directly in front of printed matter 80 when light is incident on a back surface thereof.
Figure 13D:
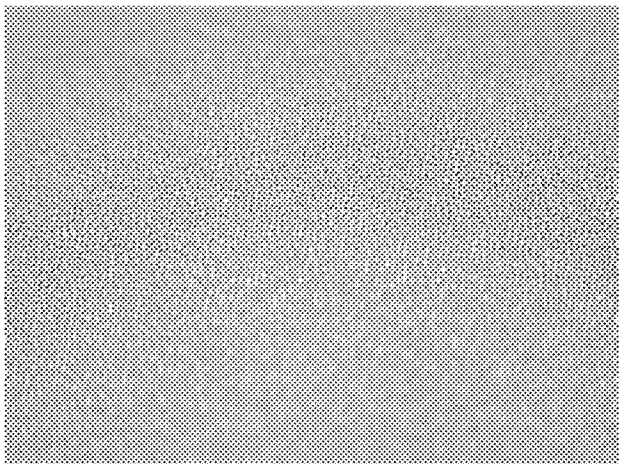
FIG. 13D is an image captured from an acute angle in front of printed matter 80 when light is incident on a back surface thereof.
Figure 13A:
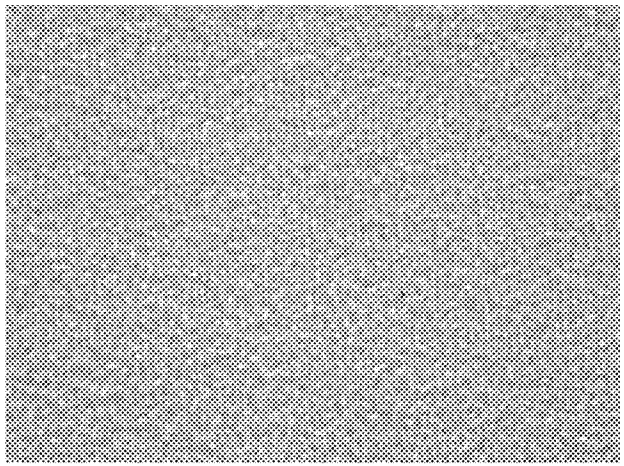
FIG. 13A is an image captured from directly in front of printed matter 70 when light is incident on a back surface thereof.

Transmission of light through the printed matter 70 is described with reference to FIG. 12A, 12C, and FIG. 13A, 13C. FIG. 12A is a cross section image taken along a scanning direction of an inkjet head when ink is applied to the printed matter 70, and FIG. 12C is a cross section image taken perpendicular to the scanning direction of the inkjet head. Further, FIG. 13A is an image captured from directly above a light emitting side of the printed matter 70 and FIG. 13C is an image captured from an oblique angle above the light emitting side of the printed matter 70.

First, as shown in FIG. 12A and FIG. 12C, light emission from a front surface thereof is excellent according to the printed matter 70 in which the light adjustment layer 107 having a density of 30% is disposed. As shown in FIG. 13A, when the printed matter 70 is imaged from directly above, the light adjustment layer 107 that has a fine-grained dot pattern is observed, and the same is true when imaged from an oblique angle, as shown in FIG. 13C.

Figure 13C:
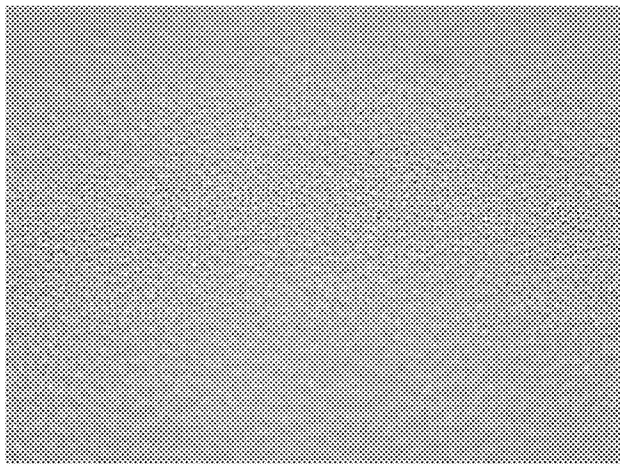
FIG. 13C is an image captured from an acute angle in front of printed matter 70 when light is incident on a back surface thereof.
Figure 14A:
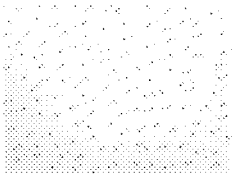
FIG. 14A to FIG. 14O are diagrams showing light transmission when density of light adjustment layer is from 2% to 30%.
Figure 14B:
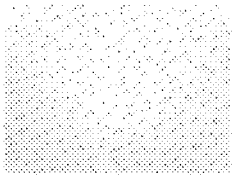
Figure 14C:
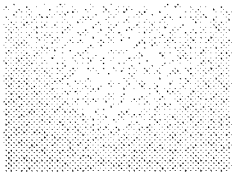
Figure 14D:
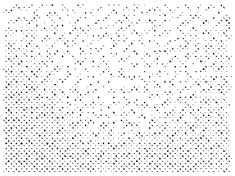
Figure 14E:
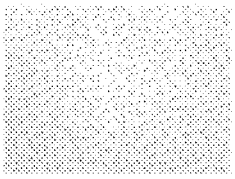
Figure 14F:
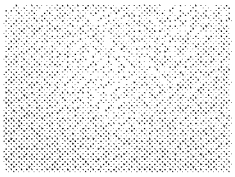
Figure 14G:
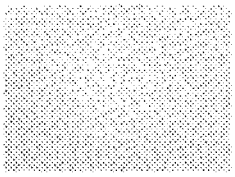
Figure 14H:
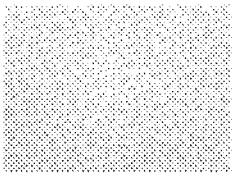
Figure 14I:
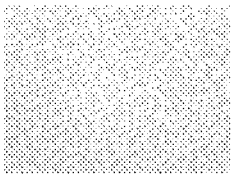
Figure 14J:
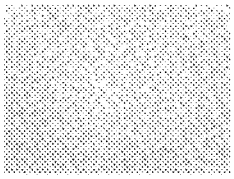
Figure 14K:
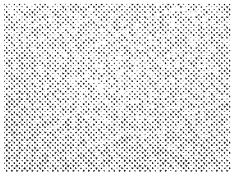
Figure 14L:
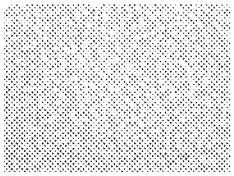
Figure 14M:
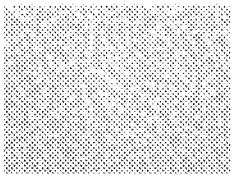
Figure 14N:
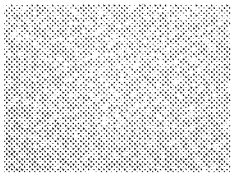
Figure 14O:
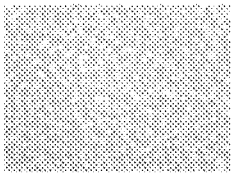
Figure 15A:
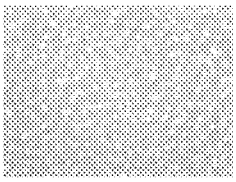
FIG. 15A to FIG. 15G are diagrams showing light transmission when density of light adjustment layer is from 40% to 100%.
Figure 15B:
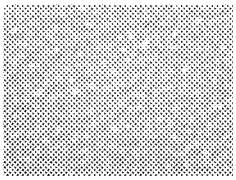
Figure 15C:
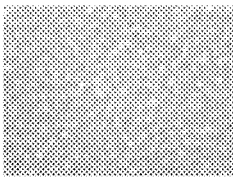
Figure 15D:
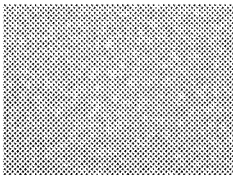
Figure 15E:
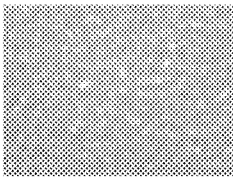
Figure 15F:
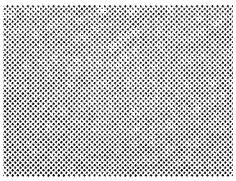
Figure 15G:
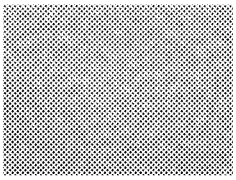

Here, when a viewer observes the printed matter 70, it is considered that viewing from at least a slight angle is common, and the printed matter 70 is mostly observed as shown in FIG. 13C. Although color of light and the like cannot be expressed in the drawings, yellowing was not observed despite use of the laminated clear layer 101.

2. Printed Matter 80

Figure 12D:
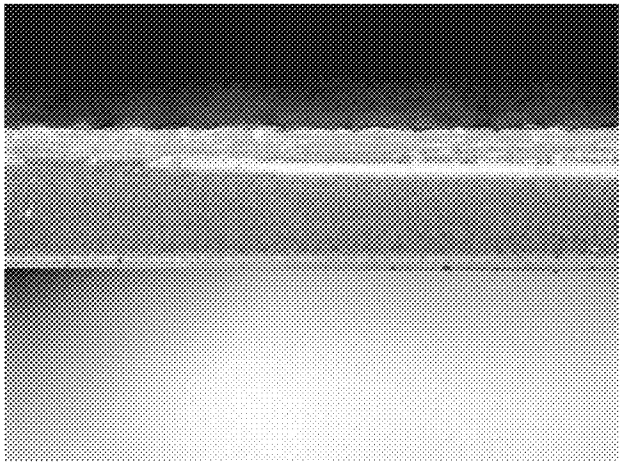
FIG. 12D is a transverse cross section image of printed matter 80 when light is incident on a back surface thereof.

Transmission of light through the printed matter 80 is described with reference to FIG. 12B, 12D, and FIG. 13B, 13D. FIG. 12B is a cross section image taken along a scanning direction of an inkjet head when ink is applied to the printed matter 80, and FIG. 12D is a cross section image taken perpendicular to the scanning direction of the inkjet head. Further, FIG. 13B is an image captured from directly above a light emitting side of the printed matter 80 and FIG. 13D is an image captured from an oblique angle above the light emitting side of the printed matter 80.

As shown in FIG. 12B and FIG. 12D, light emission from a front surface thereof is excellent according to the printed matter 80 in which the clear layers 812-815 and the light adjustment layers 807-810 alternate. As shown in FIG. 13B and FIG. 13D, when the printed matter 80 is imaged from directly above and from an oblique angle, there is no great difference from the printed matter 70.

[Formation of Light Adjustment Layer]

As shown in FIG. 2 and other drawings, according to Embodiments 1-6 and the modification above, the laminated clear layers 101, 301 directly below the light adjustment layers 107, 309, 607 are composed of the clear element layers 102-105, 302-308 in a pyramid shape in cross section, and top and side surfaces thereof are covered by the light adjustment layers 107, 309, 607. Further, according to Embodiment 7, the clear layers 812-815 alternate with the light adjustment layers 807-810.

The light adjustment layers 107, 309, 607, 807-810 are provided to suppress coloring of light, in particular transmitted light, due to clear element layers, and to realize high image quality both when an image is perceived via transmitted light and when an image is perceived via reflected light. In addition the light adjustment layers 107, 309, 607, 807-810 are provided for light that is transmitted from side surfaces of the clear element layers 102-105, 302-308, 812-815 that constitute the laminated clear layers 101, 301, 807-810 when light from the backlight 20 irradiates a back surface. That is, it is possible for a viewer to perceive a high quality image due to formation of the image on an entire area visible to the viewer and due to the disposition of the light adjustment layers 107, 309, 607, 807-810.

Further, by disposing the light adjustment layers 107, 309, 607 so as to cover the laminated clear layers 101, 301, it is also possible to emphasize texture of deep colors and sense of depth of an image.

[Configuration of Laminated Clear Layer]

According to Embodiments 1-7 and the modification above, the laminated clear layers 101, 611, 811 are composed of four clear element layers 102-105, 612-615, 812-815, respectively, and the laminated clear layer 301 is composed of seven clear element layers 302-308. The number of layers of a laminated clear layer is appropriately defined in relation to each position of an image to be expressed by the color layer. For example, the number of layers may be changed according to a surface condition of cloth, wood, leather, metal, and the like.

[Light Adjustment Layer Density]

Light adjustment layer density (light adjustment layer coverage of a surface of a layer thereunder, in teams of surface area ratio in plan view) is described with reference to FIG. 14A to FIG. 14O, and FIG. 15A to FIG. 15G.

As shown in FIG. 14A to FIG. 14O, FIG. 15A, and FIG. 15B, when density of a light adjustment layer is from 2% to 50%, high image quality can be maintained in both a mode of perceiving an image via transmitted light and a mode of perceiving an image via reflected light. In particular, the range from 20% to 30% shown in FIG. 14J to FIG. 14O is preferred.

On the other hand, as shown in FIG. 15C to FIG. 15G, when density of a light adjustment layer exceeds 50%, an amount of shielded light becomes high, relative to an amount of incident light, and it becomes difficult to maintain high image quality in both modes.

The density of a light adjustment layer can be appropriately set taking into account a number of clear layers formed, color of a color layer, texture of an image to be expressed, and the like.

[Light Adjustment Layer Density and Thickness]

According to Embodiments 1 to 7 and the modification above, UV ink is applied by an inkjet device, and the UV ink is dried to form a light adjustment layer. When a light adjustment layer is formed through a process of ink application and drying, there is a correlation between density and thickness (minimum thickness) of the light adjustment layer. Correlation between density and thickness of a light adjustment layer is shown in Table 1.

TABLE 1

| Density | Thickness |
|---|---|
| 100% | 0.030 mm |
| 50% to 100% | 0.029 mm |
| 40% to 50% | 0.025 mm |
| 30% to 40% | 0.020 mm |
| 20% to 30% | 0.017 mm |
| 10% to 20% | 0.014 mm |
| less than 10% | 0.010 mm |

Note:
one printing of a light adjustment layer

Here, "thickness" indicates a maximum height of a dot (see FIG. 4B) of a light adjustment layer.

As shown in Table 1, the higher the density of a light adjustment layer, the thicker the thickness of the light adjustment layer. More specifically, when density is less than 10%, thickness is 0.010 mm, when density is 30%, thickness is 0.020 mm, and when density is 100%, thickness is 0.030 mm.

For reference, a relationship between density and thickness of a color layer when printed twice is shown in Table 2.

TABLE 2

| Density | Thickness |
|---|---|
| 100% | 0.046 mm |
| 60% to 100% | 0.033 mm |
| 50% to 60% | 0.029 mm |
| 40% to 50% | 0.028 mm |
| 30% to 40% | 0.023 mm |
| 20% to 30% | 0.021 mm |
| 10% to 20% | 0.016 mm |
| less than 10% | 0.015 mm |

Note:
two printings of a color layer

As shown in Table 2, as density of a twice-printed color layer increases, thickness increases. Numerical values are different from those of a light adjustment layer shown in Table 1, but the same trend can be seen.

As above, when specifying density of a light adjustment layer, it is also necessary to consider a relationship with layer thickness of the light adjustment layer to be formed.

Other Modifications

According to Embodiments 1-7 and the above modification, the light diffusion plate 100 is used as the substrate, but the present invention is not limited to this example. Aside from a light diffusion plate disposed on the light guide plate 22 of the backlight 20, a substrate made of resin or glass can be used. Thus, the degree of freedom in selection of material for use as a substrate increases, and appropriate selection can be made in consideration of image quality.

When a substrate made of resin or glass is used, it is preferable to use a glossy material in consideration of light transmission rate, but a matt material (a material subjected to a matt treatment) can also be used in consideration of an image to be formed.

Further, as the substrate, it is possible to use a flexible substrate such as a film, or a substrate such as Japanese paper or thinly-sliced wood.

Further, according to Embodiments 1-7 and the above modification, the light adjustment layers 107, 309, 607, 807-810 and the second light adjustment layer 512 are printed in a dot pattern by using an inkjet device, but the present invention is not limited to this example. For example, it is also possible for form a layer by bonding light-reflective particles directly to a surface of an underlying layer by using a method such as sputtering, chemical vapor deposition (CVD), or the like. However, from a perspective of manufacturing cost it is desirable to use a resin that is easy to form by using an inkjet device.

Further, as light reflecting particles included in the light adjustment layer, particles made of material other than titanium oxide, reflective coating on surfaces of light-transmissive resin, or the like can be used. Further, a particle shape of the light reflecting particles is not limited to a spherical shape. For example, cylindrical or polyhedral shapes can be used.

Further, when forming the light adjustment layer on a surface of an underlying layer, the light adjustment layer is not required to be in a dot pattern. For example, halftone can be used, and a form can be used in which adjacent dots are connected to each other.

According to Embodiments 1-5 and the modification above, no particular reference is made to material of the clear element layers 102-105, 302-308, 612-615, 812-815 that constitute the laminated clear layers 101, 301, 611, 811, but use of resin material is preferred from a perspective of easy formation by using an inkjet device. However, in consideration of image texture and the like, silicon oxide, silicon nitride, silicon oxynitride, and the like can be used.

According to Embodiments 1-5 and the modification above, the color layers 106, 310 and the laminated color layer 606 are formed by printing four colors of ink (C, M, Y, K), but the present invention is not limited to this example. For example, three or less of the four colors can be used, and six colors can be used, adding colors such as light cyan (LC) and light magenta (KM) to the four colors.

Further, for the ink that forms the color layer, fluorescent ink, phosphorescent ink, or the like can also be used. Further, blacklight ink or the like can be used.

Further, monotone printing is included according to the printed matter of the present invention.

According to Embodiments 1-5 and the modification above, the printed matter 10, 30, 40, 45, 50, 60, 70, 80 is used as a part of the illumination device 1, but the present invention is not limited to this example, and the printed matter can achieve the effects described above independently. For example, the printed matter can achieve the effects described above when attached to an existing lighting device or a building window.

According to Embodiments 1-7 and modifications thereof, an "edge light" device is used as a backlight, but the present invention is not limited to this example. For example, a direct type of backlight can be used. Further, a light guide plate is not necessarily required. As specific examples, in a case of an organic electroluminescence (EL) panel or inorganic EL panel, a configuration without a light guide plate can be used.

According to Embodiments 1-7 and modifications thereof, the LED 21 is used as a light source, but the present invention is not limited to this example. For example, a hot cathode lamp, a cold cathode lamp, an inorganic EL lamp, an organic EL lamp, or the like can be used. Further, light-emission color of a light source is not limited to white, and various wavelength ranges of emitted light may be used. It is also possible to adjust wavelength range of light absorbed and reflected by the light adjustment layer according to the wavelength range of light emitted from the light source.

Further, in a case of use of a light source that emits light of a color other than white, it is also possible to dispose a wavelength conversion member in the light path to convert the light to white. As a specific example of a wavelength conversion member, a wavelength conversion film including a phosphor layer or semiconductor quantum dots can be used.

Further, aside from being used as an independent illumination device, the present invention can be used in combination with a display panel or the like. For example, in a case in which a flat display (for example, a liquid crystal display panel, an organic EL panel, an inorganic EL panel, etc.) is used, a configuration without a light guide plate can be used. Alternatively the present invention can be used to realize digital signage in combination with a projector. The term "lighting" in connection with the present invention is used to include display devices and the like.

Further, according to Embodiments 1-7 and modifications thereof, the light adjustment layer is disposed above the laminated clear layer and/or interposed between clear element layers, and therefore high image quality is realized both in a case in which an image is perceived via transmitted light and in a case in which an image is perceived via reflected light. Here, the phrase "high image quality" also means, for example, that a difference in image quality as perceived by a viewer is suppressed between a case in which an image is perceived via transmitted light and a case in which an image is perceived via reflected light.

INDUSTRIAL APPLICABILITY

The present invention is useful for implementing printed matter that can achieve high image quality both in a case in which a viewer perceives an image via transmitted light and in a case in which a viewer perceives an image via reflected light, as part of interior decoration, advertisement medium, or building material (wall, ceiling, and the like).

REFERENCE SIGNS LIST

1. Illumination device
10, 30, 40, 45, 50, 60, 70, 80. Printed matter
20. Backlight
21. LED
22. Light guide plate
23. Reflection plate
80. Passage
100. Light diffusion plate
101, 301, 611, 811. Laminated clear layer
102-105, 302-308, 612-615, 812-815. Clear element layer
106, 310. Color layer
107, 309, 607, 807, 808, 809, 810. Light adjustment layer
411, 451. Protective layer
512. Second light adjustment layer
606. Laminated color layer
608, 609. Color element layer
800, 801. Side wall

The invention claimed is:

1. A printed matter comprising:

a substrate that is light-transmissive;

a laminated clear layer disposed above a main surface of the substrate, the laminated clear layer being composed of a plurality of clear element layers in a series of stacked layers that are light transmissive; and a light adjustment layer that has a function of adjusting an amount of light transmitted therethrough, disposed on the laminated clear layer and/or interposed between the plurality of the clear element layers, wherein the light adjustment layer includes light reflective particles, is provided in a dot pattern on a layer immediately thereunder, covering only a portion of a surface of the layer immediately thereunder, each of the light reflective particles is granular and has a light reflective surface, and the light adjustment layer, in terms of surface area ratio in plan view, covers from 2% to 50% of the surface of the layer immediately thereunder.

2. The printed matter of claim 1, further comprising:

a color layer disposed above the main surface of the substrate, extending in a direction along the main surface of the substrate, and including one color or a plurality of colors.

3. The printed matter of claim 2, wherein the color layer is disposed covering a top surface of the laminated clear layer, and the light adjustment layer is disposed covering a top surface of the color layer and side surfaces of the laminated clear layer and the color layer.

4. The printed matter of claim 3, further comprising:

a second light adjustment layer that has a function of adjusting an amount of light transmitted therethrough, interposed between the main surface of the substrate and the laminated clear layer, wherein the second light adjustment layer includes light reflective particles that are granular and each have a light reflective surface, and the second light adjustment layer, in terms of surface area ratio in plan view, covers from 2% to 50% of a surface of a layer thereunder.

5. The printed matter of claim 4, wherein in plan view, the surface area ratio of coverage by the second light adjustment layer is greater than the surface area ratio of coverage by the light adjustment layer.

6. The printed matter of claim 2, wherein the light adjustment layer is disposed covering a top surface and side surfaces of the laminated clear layer, and the color layer is disposed covering a top surface of the light adjustment layer.

7. The printed matter of claim 2, wherein the color layer is a layered body composed of a plurality of color element layers.

8. The printed matter of claim 7, further comprising:

a protective layer that is light transmissive and disposed covering a top surface of a top layer thereunder.

9. The printed matter of claim 8, wherein the protective layer is subjected to a matt treatment.

10. The printed matter of claim 1, further comprising:

a second laminated clear layer disposed above the laminated clear layer and the light adjustment layer, composed of clear element layers that are light transmissive.

11. The printed matter of claim 1, wherein in plan view, the surface area ratio of coverage by the light adjustment layer is from 20% to 30%.

12. The printed matter of claim 1, wherein the light reflective particles of the light adjustment layer are made of white pigment.

13. The printed matter of claim 1, wherein thickness of the light adjustment layer is from 0.010 mm to 0.030 mm.

14. The printed matter of claim 1, wherein the substrate is made of resin or glass.

15. The printed matter of claim 3, wherein the protective layer is subject to a matt treatment.

16. The printed matter of claim 3, wherein a second laminated clear layer is disposed above the laminated clear layer and the light adjustment layer, composed of clear element layers that are light transmissive.

17. The printed matter of claim 3, wherein in plan view, the surface ratio of coverage by the light adjustment layer is from 20% to 30%.

18. The printed matter of claim 3, wherein the light reflective particles of the light adjustment layer are made of white pigment and the thickness of the light adjustment layer is between 0.010 mm to 0.030 mm and the substrate is made of resin or glass.

19. The printed matter of claim 1, wherein a printed image can be viewed from above a main surface of the substrate.

20. The printed matter of claim 1, wherein the layer under the light adjustment layer is one clear element layer of the plurality of the clear element layers.

* * * * *